US008033662B2

(12) United States Patent
Konno

(10) Patent No.: US 8,033,662 B2
(45) Date of Patent: Oct. 11, 2011

(54) IMAGE FORMING APPARATUS AND METHOD FOR PREVENTING IMAGE DETERIORATION DUE TO SPEED VARIATION IN AN IMTERMEDIATE TRANSFER BODY

(75) Inventor: Masaaki Konno, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 1030 days.

(21) Appl. No.: 11/902,894

(22) Filed: Sep. 26, 2007

(65) Prior Publication Data

US 2008/0074450 A1 Mar. 27, 2008

(30) Foreign Application Priority Data

Sep. 27, 2006 (JP) ..... 2006-263481

(51) Int. Cl.
*B41J 2/01* (2006.01)
*B41J 29/38* (2006.01)
*B41J 2/21* (2006.01)

(52) U.S. Cl. ..... 347/103; 347/13; 347/16; 347/43

(58) Field of Classification Search ..... 347/103, 347/13

See application file for complete search history.

(56) References Cited

U.S. PATENT DOCUMENTS 4,485,982 A * 12/1984 St. John et al. ..... 347/116
5,260,725 A * 11/1993 Hammond ..... 399/395

(Continued)

FOREIGN PATENT DOCUMENTS

JP 2000-326559 A 11/2000

(Continued)

OTHER PUBLICATIONS

Japanese Office Action issued on May 2, 2011 in corresponding Japanese patent application No. 2006-263481 (English translation attached).

*Primary Examiner* — Shelby Fidler
(74) *Attorney, Agent, or Firm* — Birch, Stewart, Kolasch & Birch, LLP

(57) ABSTRACT

The image forming apparatus has: a head which has a liquid ejection surface and performs liquid ejection in which liquid is ejected from the liquid ejection surface; an intermediate transfer body moving in a movement direction with respect to the head and having an image forming surface opposing the liquid ejection surface of the head and a rear surface which is reverse to the image forming surface and on which a line pattern constituted by pattern elements is formed, the image forming surface having an image forming region in which an image is formed by the liquid ejected from the liquid ejection surface of the head, the pattern elements being arranged equidistantly in the movement direction; a transfer device which transfers the image formed in the image forming region of the intermediate transfer body to a recording medium; a reading device which is provided on an upstream side of the head in terms of the movement direction of the intermediate transfer body and reads light reflected by the line pattern; and an ejection control device which determines a movement speed and a movement distance of the intermediate transfer body from result obtained by reading the light by means of the reading device, generates an ejection control signal for the head according to the determined movement speed and the determined movement distance of the intermediate transfer body, and controls the liquid ejection of the head according to the ejection control signal.

7 Claims, 17 Drawing Sheets

U.S. PATENT DOCUMENTS

| | | | | |
|---|---|---|---|---|
| 5,383,014 | A * | 1/1995 | Nowak et al. | 399/396 |
| 6,109,746 | A * | 8/2000 | Jeanmaire et al. | 347/103 |
| 6,155,669 | A * | 12/2000 | Donahue et al. | 347/42 |
| 6,318,853 | B1 * | 11/2001 | Asano et al. | 347/103 |
| 2004/0156654 | A1 * | 8/2004 | Nishizaki | 399/167 |
| 2006/0050099 | A1 * | 3/2006 | Murakami et al. | 347/19 |
| 2006/0077220 | A1 | 4/2006 | Nakayama | |
| 2006/0153591 | A1 * | 7/2006 | Morita et al. | 399/132 |
| 2006/0170752 | A1 | 8/2006 | Kadomatsu et al. | |

FOREIGN PATENT DOCUMENTS

| | | | |
|---|---|---|---|
| JP | 2005-350195 | A | 12/2005 |
| JP | 2006-76074 | A | 3/2006 |
| JP | 2006-130914 | A | 5/2006 |
| JP | 2006-154289 | A | 6/2006 |
| JP | 2006-205677 | A | 8/2006 |

* cited by examiner

IMAGE FORMING APPARATUS AND METHOD FOR PREVENTING IMAGE DETERIORATION DUE TO SPEED VARIATION IN AN IMTERMEDIATE TRANSFER BODY

BACKGROUND OF THE INVENTION

1. Field of the Invention

The present invention relates to an image forming apparatus and an image forming method, and more particularly, to technology for preventing decline in image quality caused by variation in the speed of an intermediate transfer body when forming an image on the intermediate transfer body in the image forming apparatus which uses a transfer method by which an image is formed on the intermediate transfer body by means of a liquid ejection device, such as an inkjet head, and the image is then transferred to a recording medium.

2. Description of the Related Art

In an inkjet recording apparatus which uses a transfer method in which an image is formed on an intermediate transfer body from an inkjet head and then transferred to a recording medium, a desired image is formed on the intermediate transfer body by ejecting ink at prescribed timing while moving the intermediate transfer body at a prescribed speed. When a load is placed on the intermediate transfer body, for instance, when the image is being transferred from the intermediate transfer body to the recording medium, or when the intermediate transfer body is being cleaned, then a speed variation occurs in the intermediate transfer body, even if the drive source of the intermediate transfer body is controlled to a uniform speed. When an image is formed by an inkjet head on the intermediate transfer body, in a state where speed variation occurs in the intermediate transfer body in this way, then displacement occurs in the positions at which the dots are formed, due to the speed variation of the intermediate transfer body directly below the inkjet head, and therefore the image quality is markedly degraded. In order to resolve this problem, various methods have been proposed for preventing decline in the image quality caused by speed variation of the intermediate transfer body in an image forming apparatus based on a transfer method which uses the intermediate transfer body.

Japanese Patent Application Publication No. 2000-326559 discloses an invention related to a transfer type of inkjet recording apparatus in which deterioration of image quality is prevented by avoiding use of devices which are involved in image formation, such as a device which applies treatment liquid to the intermediate transfer body, a transfer device, a separating device, during image recording by the inkjet head.

However, in the invention described in Japanese Patent Application Publication No. 2000-326559, since image formation onto the intermediate transfer body is halted during transfer or cleaning. Although this is effective in preventing image deterioration, productivity is adversely affected.

SUMMARY OF THE INVENTION

The present invention has been contrived in view of these circumstances, an object thereof being to provide an image forming apparatus and an image forming method which prevent image deterioration caused by displacement in the ink depositing positions due to speed variation in an intermediate transfer body in an inkjet image forming apparatus using a transfer method, in order to form an image of high quality.

In order to attain the aforementioned object, the present invention is directed to an image forming apparatus comprising: a head which has a liquid ejection surface and performs liquid ejection in which liquid is ejected from the liquid ejection surface; an intermediate transfer body moving in a movement direction with respect to the head and having an image forming surface that opposes the liquid ejection surface of the head and has an image forming region in which an image is formed by the liquid ejected from the liquid ejection surface of the head, and a rear surface which is reverse to the image forming surface and on which a line pattern constituted by pattern elements arranged equidistantly in the movement direction is formed; a transfer device which transfers the image formed in the image forming region of the intermediate transfer body to a recording medium; a reading device which is provided on an upstream side of the head in terms of the movement direction of the intermediate transfer body and reads light reflected by the line pattern; and an ejection control device which determines a movement speed and a movement distance of the intermediate transfer body from result obtained by reading the light by means of the reading device, generates an ejection control signal for the head according to the determined movement speed and the determined movement distance of the intermediate transfer body, and controls the liquid ejection of the head according to the ejection control signal.

According to this aspect of the invention, since the movement speed and the movement distance of the intermediate transfer body are determined and an ejection control signal is generated on the basis of the determination results, then it is possible to prevent displacement of the ink depositing positions on the intermediate transfer body, even if there is variation in the speed of the intermediate transfer body directly below the inkjet head, due to load variations, or the like. Hence, a desirable image is formed which does not suffer quality deterioration caused by the displacement of the dot positions.

Furthermore, in a case where the line pattern and/or the determination unit for determining the movement speed and the movement position of the intermediate transfer body are provided on the rear side of the intermediate transfer body with respect to the liquid ejection surface, soiling of the line pattern and/or the determination unit by the liquid or mist is suppressed, thus helping to reduce the cleaning burden for the line pattern and the determination unit.

For the determination element, it is suitable to use a reflective determination element (sensor) which outputs a signal corresponding to the intensity of the reflected light from the line pattern. Furthermore, it is also possible to provide a light-emitting device which radiates light onto the line pattern, in the determination device.

Preferably, the line pattern is disposed in a central portion, in terms of a direction perpendicular to the movement direction, of a pattern forming region of the rear surface of the intermediate transfer body, the pattern forming region corresponding to the image forming region.

According to this aspect of the invention, it is possible to determine speed variation in the central portion of the image forming region, in the direction perpendicular to the direction of movement of the intermediate transfer body, and ejection control error can be minimized in the whole ejection head, in relation to all of the nozzles which correspond to the entire width of the image forming region, by means of determination performed in a single location in the central region.

Preferably, a plurality of the line patterns are disposed in the movement direction respectively in vicinities of both edges of the image forming region in terms of a direction perpendicular to the movement direction.

According to this aspect of the invention, it is possible to determine speed variation in either edge region of the image forming region, in terms of the direction perpendicular to the direction of movement of the intermediate transfer body, and ejection control error can be minimized in the whole ejection head, in relation to all of the nozzles which correspond to the entire width of the image forming region.

Preferably, a plurality of the heads corresponding to different types of the liquids are provided; and a plurality of the reading devices are provided in such a manner that at least one reading device is disposed on an upstream side of each of the heads in terms of the movement direction of the intermediate transfer body, and an arrangement interval between each of the reading devices and the head corresponding to each of the reading devices is less than an arrangement interval between the heads which are provided adjacently.

According to this aspect of the invention, in a mode where a plurality of heads are provided, by providing reading devices for each of the heads, it is possible to shorten the time lag from the determination of a signal by means of each of the reading devices to the generation of an ejection control signal for the head, at each of the reading devices. Therefore, suitable ejection control can be implemented in respect of each head.

Modes in which a plurality of heads are provided may include a mode where heads are provided to correspond to inks of respective colors. For example, there is a mode where a C ink head, an M ink head, a Y ink head and a K ink head are provided.

Preferably, a plurality of the heads are provided; a plurality of the reading devices are provided in such a manner that n reading devices (where n is an integer not less than 2) are provided with respect to each of the plurality of the heads, the n reading devices being arranged in the movement direction of the intermediate transfer body at an arrangement interval of 1/n of an arrangement interval of the pattern elements of the line pattern.

According to this aspect of the invention, the resolution of movement speed determination and movement distance determination of the intermediate transfer body is improved, thus further contributing to the suppression of determination errors.

Preferably, the plurality of the heads are arranged in the movement direction of the intermediate transfer body at an arrangement interval which is a multiple of m times an arrangement interval of the pattern elements of the line pattern (where m is an integer not less than 2).

According to this aspect of the invention, by making the distance between heads equal to an integral multiple of the arrangement pitch of the line pattern, then if ejection control is carried out for each of the heads on the basis of the signal obtained from the reading device, there is no need to correct for fine determination time delays which causes shortening of the line pattern reading cycle, in respect of the heads. Therefore, ejection from the heads can be controlled accurately by means of a simple composition and a simple process.

Preferably, a plurality of the heads are provided so as to include an ink ejection head ejecting ink containing coloring material and a treatment liquid deposition head depositing, onto the intermediate transfer body, treatment liquid which insolubilizes or aggregates the coloring material contained in the ink, the treatment liquid deposition head being arranged on an upstream side of the ink ejection head in terms of the movement direction of the intermediate transfer body; and a plurality of the reading devices are provided in such a manner that at least one reading device is provided on an upstream side in terms of the movement direction of the intermediate transfer body with respect to each of the plurality of the heads including the ink ejection head and the treatment liquid deposition head, and an arrangement interval between each of the reading devices and the head corresponding to each of the reading devices is less than an arrangement interval between the heads which are provided adjacently.

According to this aspect of the invention, in a two-liquid reaction type of system which uses treatment liquid and colored ink, it is possible to eject droplets of the treatment liquid and the ink onto the intended positions, and therefore a reliable reaction between the treatment liquid and the ink can be achieved.

In a case where a two-liquid reaction system which ejects droplets of a treatment liquid which insolubilizes or aggregates the coloring material in the ink before ejecting the ink, even if the reaction of the ink with the treatment liquid occurs and landing interference occurs whereby the liquid moves due to mutual contact between ink droplets on the intermediate transfer body, it is possible to suppress movement of the ink (coloring material), and it is possible to separate the coloring material and the solvent liquid and thereby remove the solvent liquid only.

In the case of a two-liquid reaction system of this kind, the treatment liquid and the ink must react together reliably on the intermediate transfer body, and therefore sufficient beneficial effects cannot be obtained if there is displacement between the depositing positions of the treatment liquid and the ink. Consequently, the ejection from the treatment liquid head is controlled by determining the movement speed and the movement distance of the intermediate transfer body in the vicinity of the treatment liquid head while the ejection from the ink head is controlled by determining the movement speed and the movement distance of the intermediate transfer body in the vicinity of the ink head, and thereby it is possible to eject droplets of treatment liquid and ink onto the intended positions and thus ensure a reliable reaction between the treatment liquid and the ink, even if speed variation of the intermediate transfer body occurs in the period from ejecting droplets of treatment liquid to ejecting droplets of ink.

A desirable mode is one which comprises a solvent liquid removal device which removes solvent liquid after separation of the coloring material and the solvent liquid.

In order to attain the aforementioned object, the present invention is also directed to an image forming method comprising the steps of: moving an intermediate transfer body in a movement direction with respect to a head which ejects liquid; reading in light reflected by a line pattern constituted by pattern elements disposed equidistantly in the movement direction on a rear surface of the intermediate transfer body by using a reading device provided on an upstream side of the head in terms of the movement direction of the intermediate transfer body, the rear surface being reverse to an image forming surface of the intermediate transfer body opposing a liquid ejection surface of the head; determining a movement speed and a movement interval of the intermediate transfer body from result obtained by reading the light by means of the reading device; generating an ejection control signal for the head according to the determined movement speed and the determined movement interval of the intermediate transfer body; causing the head to eject the liquid according to the ejection control signal so as to form an image on the image forming surface of the intermediate transfer body; and transferring the image formed on the image forming surface of the intermediate transfer body to a recording medium.

According to the present invention, since the movement speed and the movement distance of the intermediate transfer body are determined and an ejection control signal is generated on the basis of the determination result, then it is possible to prevent displacement of the liquid depositing positions on the intermediate transfer body, even if there is variation in the speed of the intermediate transfer body directly below the ejection head, due to load variations, or the like. Hence, a desirable image is formed which does not suffer quality deterioration caused by the displacement of the dot positions.

Furthermore, in a case where the line pattern and the determination unit for determining the movement speed and the movement position of the intermediate transfer body are provided on the rear side of the intermediate transfer body with respect to the liquid ejection surface, soiling of the line pattern or the determination unit by liquid or mist is suppressed, thus helping to reduce the cleaning burden for the line pattern and the determination unit.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Apparatus

Figure 1:
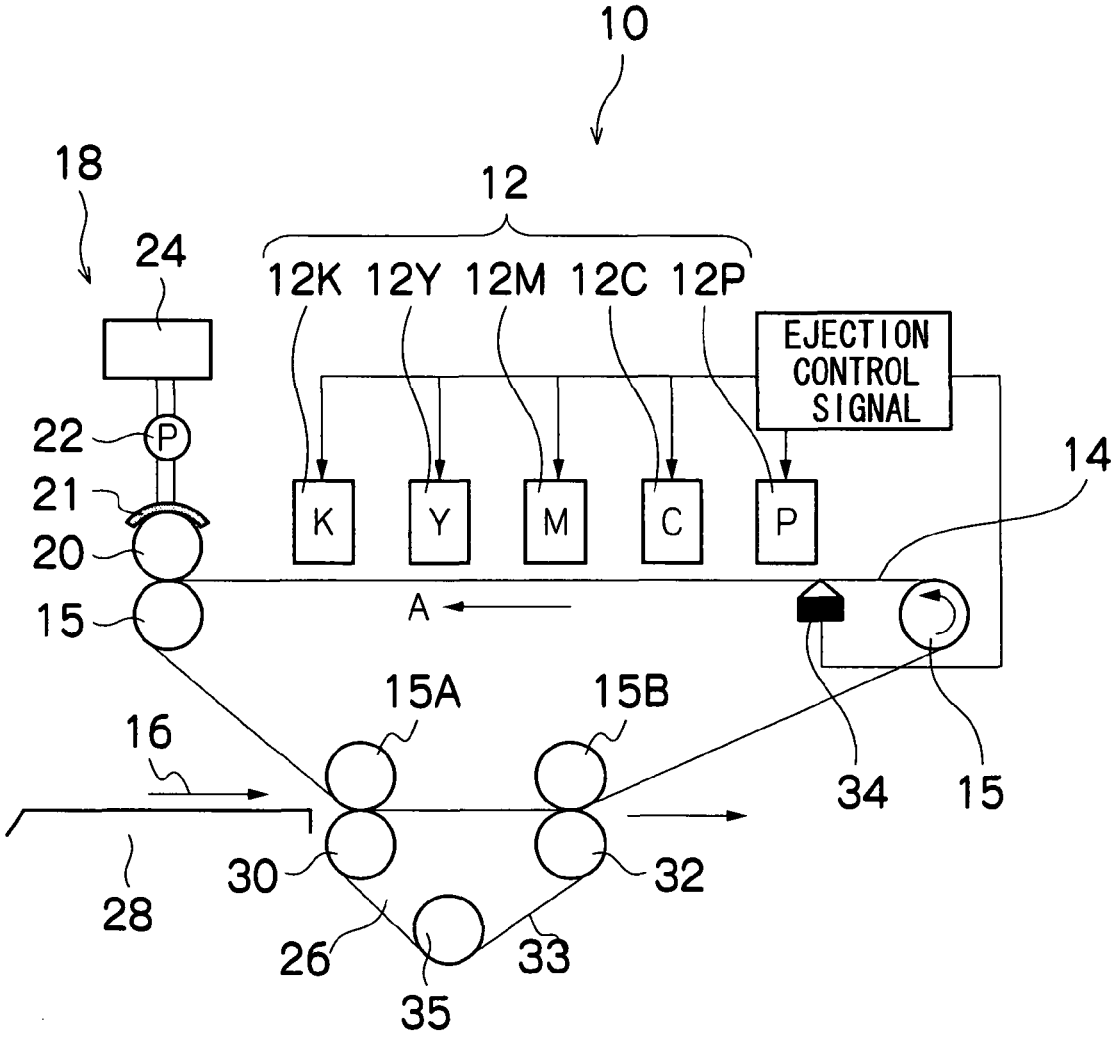
FIG. 1 is a basic schematic drawing of an inkjet recording apparatus relating to an embodiment of the present invention.

FIG. 1 is a diagram of the general composition of an inkjet recording apparatus relating to an embodiment of the present invention. The inkjet recording apparatus 10 according to FIG. 1 uses a transfer method in which an image is formed on an intermediate transfer body 14 by ejecting inks of respective colors of C, M, Y and K by moving the intermediate transfer body 14 in one direction, in relation to the heads of a print unit 12 having heads 12C, 12M, 12Y and 12K corresponding to inks of the respective colors of C, M, Y and K, and the image formed on the intermediate transfer body 14 is then transferred onto a recording medium 16.

Furthermore, the print unit 12 has a treatment liquid head 12P provided on the upstream side of the heads 12C, 12M, 12Y and 12K in terms of the direction of movement of the intermediate transfer body, and uses a system based on liquid reaction. In the liquid reaction, ink is ejected onto the image forming region of the intermediate transfer body 14 on which treatment liquid has been deposited previously by using the treatment liquid head 12P, and the ink and the treatment liquid react with each other, thereby insolublizing or aggregating the coloring material in the ink and separating the coloring material component from the solvent liquid. Consequently, an image is formed on the intermediate transfer body 14 by means of the coloring material component.

The print unit 12 comprises the heads which eject treatment liquid (P) and inks corresponding to the respective colors of cyan (C), magenta (M), yellow (Y) and black (K), arranged in succession from the upstream side in terms of the direction of movement of the intermediate transfer body 14. A color image can be formed on the image forming region of the intermediate transfer body 14 by successively ejecting the treatment liquid and inks of respective colors from the respective heads while moving the intermediate transfer body 14 in the direction from the head 12P to the head 12K (the direction of movement of the intermediate transfer body).

An endless belt wrapped about a plurality of rollers 15 is used for the intermediate transfer body 14, and when at least one roller (a drive roller) of the plurality of rollers 15 is rotated in the counter-clockwise direction in FIG. 1, by means of a motor, the intermediate transfer body 14 is moved from right to left in FIG. 1 in the print region (ejection region) directly below the print unit 12. Although not shown in the drawings, it is necessary to keep the intermediate transfer body 14 flat in the print region of the print unit 12, and a tension roller which adjusts the tension of the intermediate transfer body 14 is provided in order to keep the intermediate transfer body 14 flat.

A solvent removal unit 18 which removes excess solvent from the intermediate transfer body 14 is provided on the downstream side of the print unit 12 in terms of the direction of movement of the intermediate transfer body. This solvent removal unit 18 comprises: an absorbing roller 20 which absorbs and removes solvent by making contact with the image forming region of the intermediate transfer body 14; a withdrawal/pressurization drive unit 21 which switches the absorbing roller 20 between a state of non-contact (withdrawn state) and a state of contact (pressurized state) with respect to the intermediate transfer body 14, by moving the absorbing roller 20 in the vertical direction; a pump 22 which suctions moisture (solvent) absorbed by the absorbing roller 20; and a recovery unit 24 which recovers the moisture suctioned by the pump 22.

The absorbing roller 20 uses an absorbent material having absorbing characteristics, such as a porous member, a polymer absorbing member, or the like. For the absorbing roller 20, it is also possible to use a non-absorbent roller, made of metal, resin, or the like, which has a plurality of fine holes provided in the surface of the roller 20, the excess solvent on the intermediate transfer body 14 being suctioned and removed by means of a pump 22 by making the surface of the absorbing roller 20 come into contact with the solvent on the intermediate transfer body 14 (without making the surface of the absorbing roller 20 come into contact with the intermediate transfer body 14 or the image on the intermediate transfer body 14.)

The image on the intermediate transfer body 14 from which the unnecessary solvent has been removed by the solvent removal unit 18 is moved to the transfer unit 26 provided on the downstream side of the solvent removal unit 18 in terms of the direction of movement of the intermediate transfer body, and is then transferred to a recording medium 16 supplied from the paper supply unit 28, in the transfer unit 26.

The transfer unit 26 comprises a pressing roller 30 which presses the recording medium 16 against the intermediate transfer body 14 and an output roller 32 which outputs the recording medium 16 from the transfer unit 26. An endless belt 33 is wound about the pressing roller 30 and the output roller 32. The belt 33 in the transfer unit 26 is composed in such a manner that the tension of the belt 33 is adjustable by means of a tension roller 35.

By applying a prescribed pressure to the intermediate transfer body 14 and the recording medium 16 by sandwiching the intermediate transfer body 14 and the recording medium 16 between the roller 15A about which the intermediate transfer body 14 is wound, and the pressing roller 30, the image formed on the intermediate transfer body 14 is transferred to the recording medium 16.

The recording medium 16 onto which the image has been transferred is output to the exterior of the apparatus by means of the output roller 32. Although not shown in the drawings, an output tray is provided in order to accommodate the recording medium 16 onto which an image has been recorded and which has been output to the exterior of the apparatus. A desirable mode is one in which a plurality of output trays are provided respectively for different types of images.

In a mode where a medium which has not been cut to a prescribed length, such as continuous paper, is used for the recording medium 16, it is desirable to provide a cutter which cuts the recording medium 16 to a prescribed size before the transfer unit 26, and a mechanism for removing curl from the recording medium 16.

A determination unit 34 which determines a line pattern (not shown in FIG. 1 and indicated by reference numeral 100 in FIG. 7) which is formed on the inner circumferential surface of the intermediate transfer body 14 (the inner surface on the opposite side to the image forming surface) is provided on the upstream side of the print unit 12 in terms of the direction of movement of the intermediate transfer body. As described in more detail below, in the inkjet recording apparatus 10 according to the present example, the line pattern described above is read in by the determination unit 34, the variation in the speed of the intermediate transfer body 14 is determined, and ejection control signals (trigger signals) are then generated for the respective heads 12P, 12C, 12M, 12Y and 12K of the print unit, on the basis of the determination results, and ejection from the heads 12P, 12C, 12M, 12Y and 12K is controlled on the basis of these ejection control signals.

Figure 2:
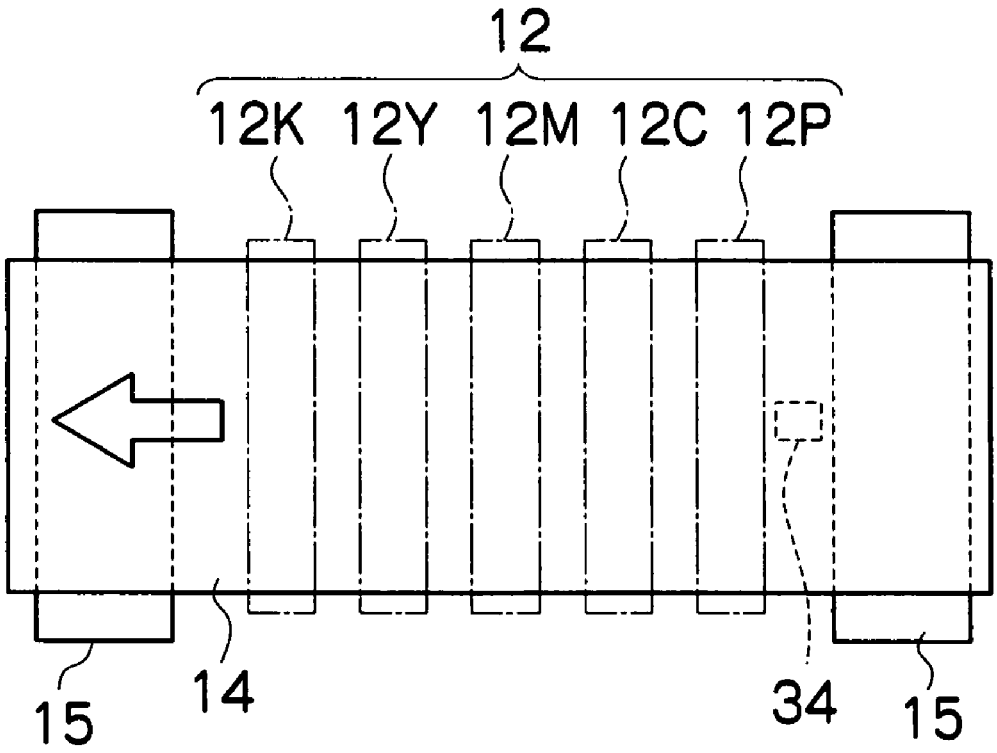
FIG. 2 is a schematic plan diagram of the inkjet recording apparatus shown in FIG. 1.

FIG. 2 is a principal plan diagram showing the composition of the peripheral area of the print unit 12. As shown in FIG. 2, the heads 12P, 12C, 12M, 12Y and 12K of the print unit 12 are constituted by line type heads in which a plurality of nozzles are arranged through a length exceeding the maximum width of the intermediate transfer body 14. In this way, by means of the full line type heads 12P, 12C, 12M, 12Y and 12K which cover the full width of the intermediate transfer body 14, it is possible to form an image over the whole area of the image forming region of the intermediate transfer body 14, by means of one operation of moving (scanning) the intermediate transfer body 14 and the heads 12P, 12C, 12M, 12Y and 12K, relatively to each other, just once (by one sub-scanning). Higher-speed printing is thereby made possible and productivity can be improved in comparison with a serial type head configuration in which a head moves reciprocally in the breadthways direction of the intermediate transfer body 14.

Although a configuration with four standard colors, C, M, Y and K, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

Furthermore, in the present example, a two-liquid type of composition is described in which inks of respective colors are used with a treatment liquid which reacts with the inks to cause the inks to cure, but a mode is also possible in which the treatment liquid is omitted and the ink is fixed onto the intermediate transfer body 14 by using a curing device, such as a heater, cooling fan, or the like.

Description of Structure of the Head

Next, the structure of the heads 12P, 12C, 12M, 12Y and 12K is described below in detail. The heads 12P, 12C, 12M, 12Y and 12K have the same structure, and a reference numeral 50 is hereinafter designated to any of the heads.

Figure 3A:
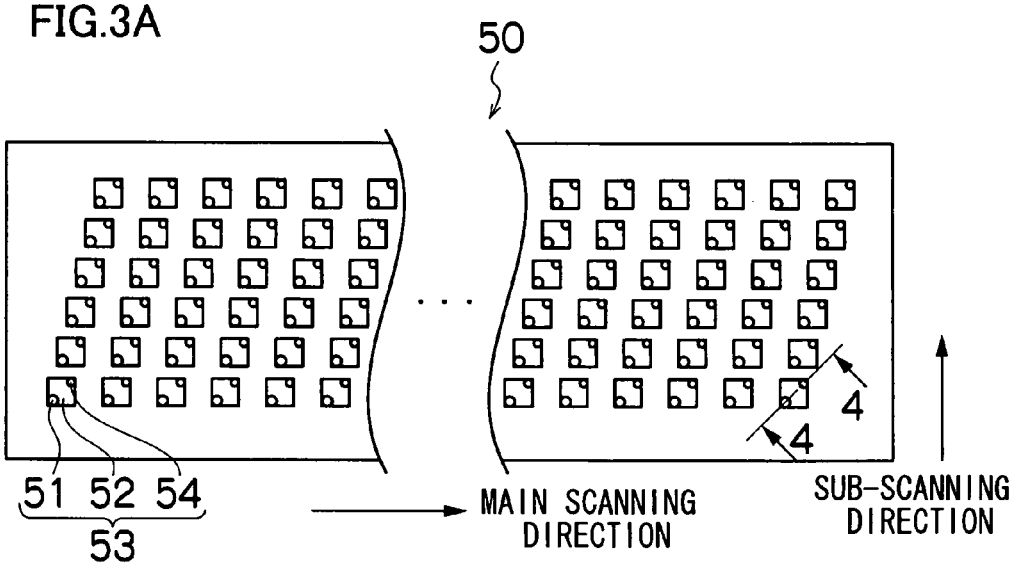
FIGS. 3A to 3C are plan diagrams showing examples of the nozzle arrangement in the ejection head shown in FIG. 1.
Figure 3B:
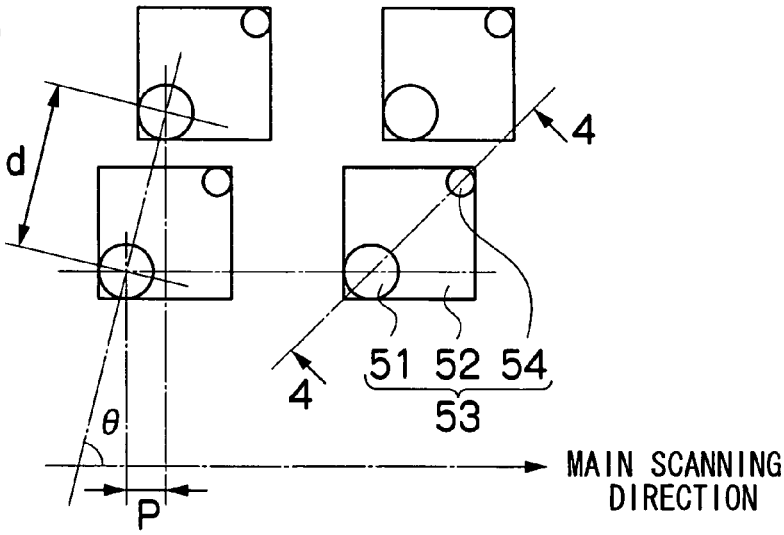

FIG. 3A is a plan view perspective diagram showing an example of the structure of a head 50; and FIG. 3B is a plan view perspective diagram showing a further example of the structure of the head 50. Furthermore, FIG. 3C is a plan view perspective diagram showing a further example of the structure of the head 50.

Figure 3C:
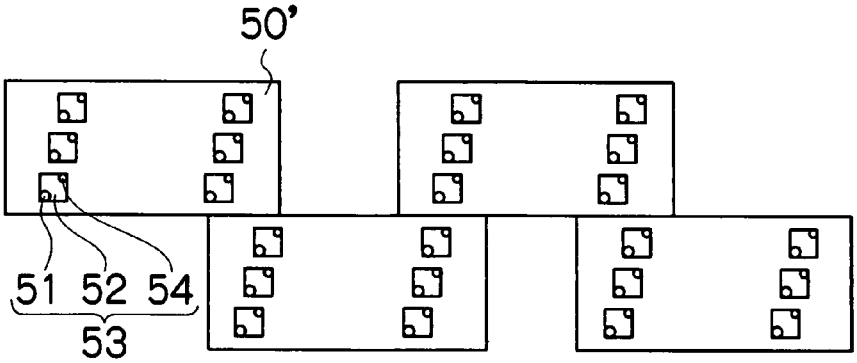

As shown in FIGS. 3A to 3C, the head 50 according to the present embodiment has a structure in which a plurality of ejection elements 53, each comprising a nozzle 51 from which a droplet of treatment liquid or ink are ejected and a pressure chamber 52 connecting to the nozzle 51, are disposed in the form of a staggered matrix, and the effective nozzle pitch is thereby made small.

More specifically, as shown in FIGS. 3A and 3B, the head 50 according to the present embodiment is a full-line head having one or more nozzle rows in which a plurality of nozzles 51 for ejecting liquid droplets are arranged through a length corresponding to the width of the image forming region of the intermediate transfer body 14 (see FIG. 1), in the main scanning direction (the lengthwise direction of the head 50, which is substantially perpendicular to the direction of movement of the intermediate transfer body).

Moreover, as shown in FIG. 3C, a full-line head can be composed of a plurality of short two-dimensionally arrayed head units 50' disposed in a staggered arrangement and combined so as to form nozzle rows having lengths that correspond to the entire width of the image forming region. Furthermore, although not shown in the drawings, it is also possible to connect such short heads in a linear fashion.

As shown in FIGS. 3A to 3C, the pressure chamber 52 provided corresponding to each of the nozzles 51 is approximately square-shaped in plan view, and a nozzle 51 and a supply port 54 are provided respectively at either corner of a diagonal of the pressure chamber 52. Moreover, each of the pressure chambers 52 is connected via a supply port 54 to a common liquid chamber (not shown in FIGS. 3A to 3C; and indicated by reference numeral 55 in FIG. 4).

Figure 4:
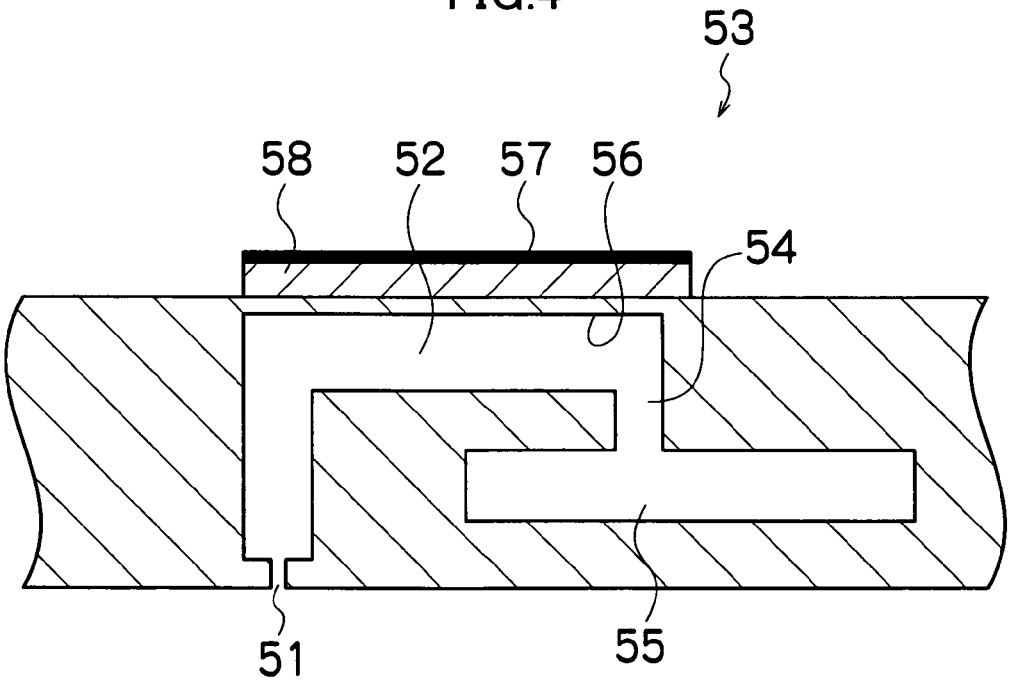
FIG. 4 is a cross-sectional diagram showing the head.

As shown in FIG. 4, piezoelectric elements 58 which are each provided with an individual electrode 57 are bonded to a diaphragm 56 which forms the upper face of the pressure chamber 52 and also serves as a common electrode, and each piezoelectric element 58 is deformed when a drive voltage is applied between the individual electrode 57 and the common electrode (diaphragm 56), thereby causing ink to be ejected from the nozzle 51. When ink is ejected, new ink is supplied to the pressure chamber 52 from the common flow chamber 55, via the supply port 54.

As shown in FIG. 3B, the plurality of ejection elements 53 having this structure are composed in a matrix arrangement, based on a fixed arrangement pattern having a row direction which coincides with the main scanning direction, and a column direction which, rather than being perpendicular to the main scanning direction, is inclined at a fixed angle of θ with respect to the main scanning direction. By adopting the structure in which a plurality of ejection elements 53 are arranged at a uniform pitch d in the direction having the angle θ with respect to the main scanning direction, the pitch P of the nozzles projected so as to align in the main scanning direction is $d \times \cos\theta$.

More specifically, in terms of the main scanning direction, the arrangement can be treated equivalently to one in which the nozzles 51 are arranged in a linear fashion at uniform pitch P. By means of this composition, it is possible to achieve a nozzle composition of high density, in which the nozzle columns projected to align in the main scanning direction reach a total of 2400 per inch (2400 nozzles/inch). Below, in order to facilitate the description, it is supposed that the nozzles 51 are arranged in a linear fashion at a uniform pitch (P), in the longitudinal direction of the head 50 (main scanning direction).

In a full-line head comprising rows of nozzles that have a length corresponding to the entire width of the intermediate transfer body 14, the "main scanning" is defined as printing a line formed of a row of dots, or a line formed of a plurality of rows of dots in the width direction of the intermediate transfer body 14 (the direction perpendicular to the movement direction of the intermediate transfer body 14) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIGS. 3A to 3C are driven, it is desirable that main scanning is performed in accordance with (3) described above. On the other hand, "sub-scanning" is defined as to repeatedly perform printing of one line (a line formed of a row of dots, or a line formed of a plurality of rows of dots) formed by the main scanning action, by moving the intermediate transfer body 14 described above with respect to the print unit 12.

In other words, "main scanning" is the action of driving the nozzles so as to print a line constituted by one row of dots, or a plurality of rows of dots, in the breadthways direction of the intermediate transfer body 14, and "sub-scanning" is the action of repeating the printing of a line constituted by one row of dots or a plurality of rows of dots formed by main scanning.

In implementing the present invention, the arrangement of the nozzles is not limited to that of the examples illustrated. Moreover, a method is employed in the present embodiment where an ink is ejected by means of the deformation of the actuator, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink being ejected by means of the pressure applied by these bubbles.

Description of Supply System

Figure 5:
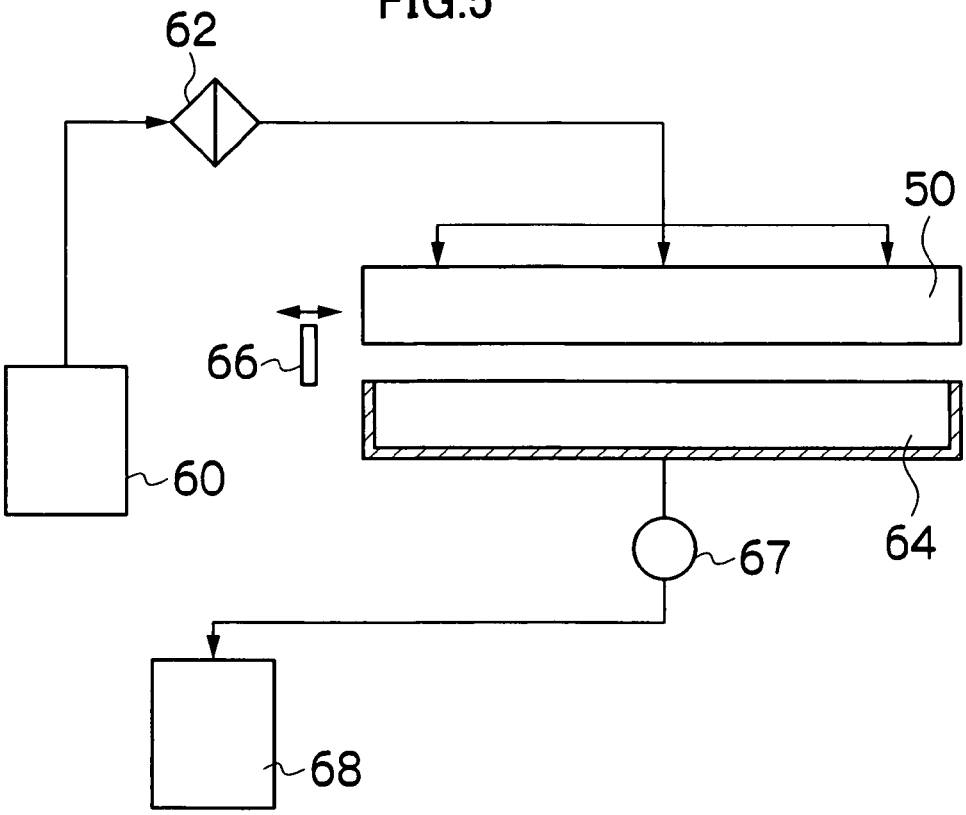
FIG. 5 is a cross-sectional diagram showing the composition of an ink supply system of the inkjet recording apparatus shown in FIG. 1.

Next, the general composition of the supply system of the inkjet recording apparatus is described below. FIG. 5 is a conceptual diagram showing the composition of an ink supply system in the inkjet recording apparatus 10. The treatment liquid supply system which supplies treatment liquid to the treatment liquid head 12P has the same composition as the ink supply system explained below, and therefore description thereof is omitted.

The ink supply tank 60 is a base tank that supplies ink. The aspects of the ink supply tank 60 include a refillable type and a cartridge type: when the remaining amount of ink is low, the ink tank 60 of the refillable type is filled with ink through a filling port (not shown) and the ink tank 60 of the cartridge type is replaced with a new one. In the case of changing the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink supply tank 60 and the head 50 as described above. The filter mesh size of the filter 62 is preferably equivalent to or less than the diameter of the nozzle and commonly about 20 μm.

It is preferable to provide a sub-tank (not shown) integrally to the print head 50 or near the head 50. The sub-tank has a damper function for preventing variation in the internal pressure of the pressure chambers 52 and the common flow chamber 55 and a function for improving refilling of the print head.

Possible modes for controlling the internal pressure of the common flow channel 55 by means of the sub tank are: a mode where the internal pressure of the pressure chambers 52 is controlled by the differential in the liquid head pressure between a sub tank which is open to the external air and the pressure chambers 52 inside the head 50; and a mode where the internal pressures of the sub tank and the pressure chambers 52 are controlled by a pump connected to a sealed sub tank; and the like. Either of these modes may be adopted.

Description of Maintenance of Head

As shown in FIG. 5, a cap 64 forming a device for preventing the drying of the nozzles 51 or increase in the viscosity of the liquid in the vicinity of the nozzles 51 is provided in the inkjet recording apparatus 10, and a blade 66 is provided as a device for cleaning (wiping) the nozzle forming surface in which the nozzles 51 are formed.

A maintenance unit including the cap 64 and the blade 66 can be relatively moved with respect to the head 50 by a movement mechanism (not shown), and is moved from a predetermined holding position to a position below the head 50 as required.

The cap 64 is displaced upward and downward in a relative fashion with respect to the print head 50 by an elevator mechanism (not shown). When the power of the inkjet recording apparatus 10 is switched off or when the inkjet recording apparatus 10 is in a print standby state, the cap 64 is raised to a predetermined raised position thereby placing same in close contact with the head 50 (the nozzle forming surface of the head 50), in such a manner that the nozzle forming surface is covered with the cap 64 and the nozzle forming surface is protected by the cap 64.

During printing or during standby, if the use frequency of a particular nozzle 51 has declined and the ink viscosity in the vicinity of the nozzle 51 has increased, then a preliminary ejection (purging, dummy ejection, spit ejection) is performed onto the cap 64, in order to remove the degraded ink.

Also, when bubbles have become intermixed in the ink inside the head 50, the cap 64 is placed on the head 50, ink (ink in which bubbles have become intermixed) is removed by suction from the nozzles 51 with a suction pump 67, and the ink removed by suction is sent to a recovery tank 68. This suction operation is also carried out in order to remove degraded ink having increased viscosity (hardened ink), when liquid is loaded into the ejection head for the first time, or when the head starts to be used after having been out of use for a long period of time.

The blade 66 functions as a wiping device for removing dirt from the nozzle forming surface by moving while pressing against the nozzle forming surface. An elastic member, or the like, is suitable for use in the blade 66. In other words, the blade 66 has a prescribed strength (rigidity) and a prescribed elasticity, and the surface thereof has prescribed hydrophobic properties which repulse the various types of liquid that are ejected from the ejection head. The blade 66 is constituted by a member which is capable of wiping the nozzle forming surface to remove liquid (liquid that has solidified on the nozzle forming surface) and other foreign matter which have adhered to the nozzle forming surface.

Furthermore, although not shown in FIG. 5, the head maintenance mechanism (head maintenance device) of the inkjet recording apparatus 10 comprises: a blade elevator mechanism (not shown), which moves the blade 66 in the upward and downward directions and thus switches the blade 66 between a state of contact with the nozzle forming surface and a state of non-contact with the nozzle forming surface; and a cleaning device which removes foreign matter adhering to the blade 66.

Description of Control System

Figure 6:
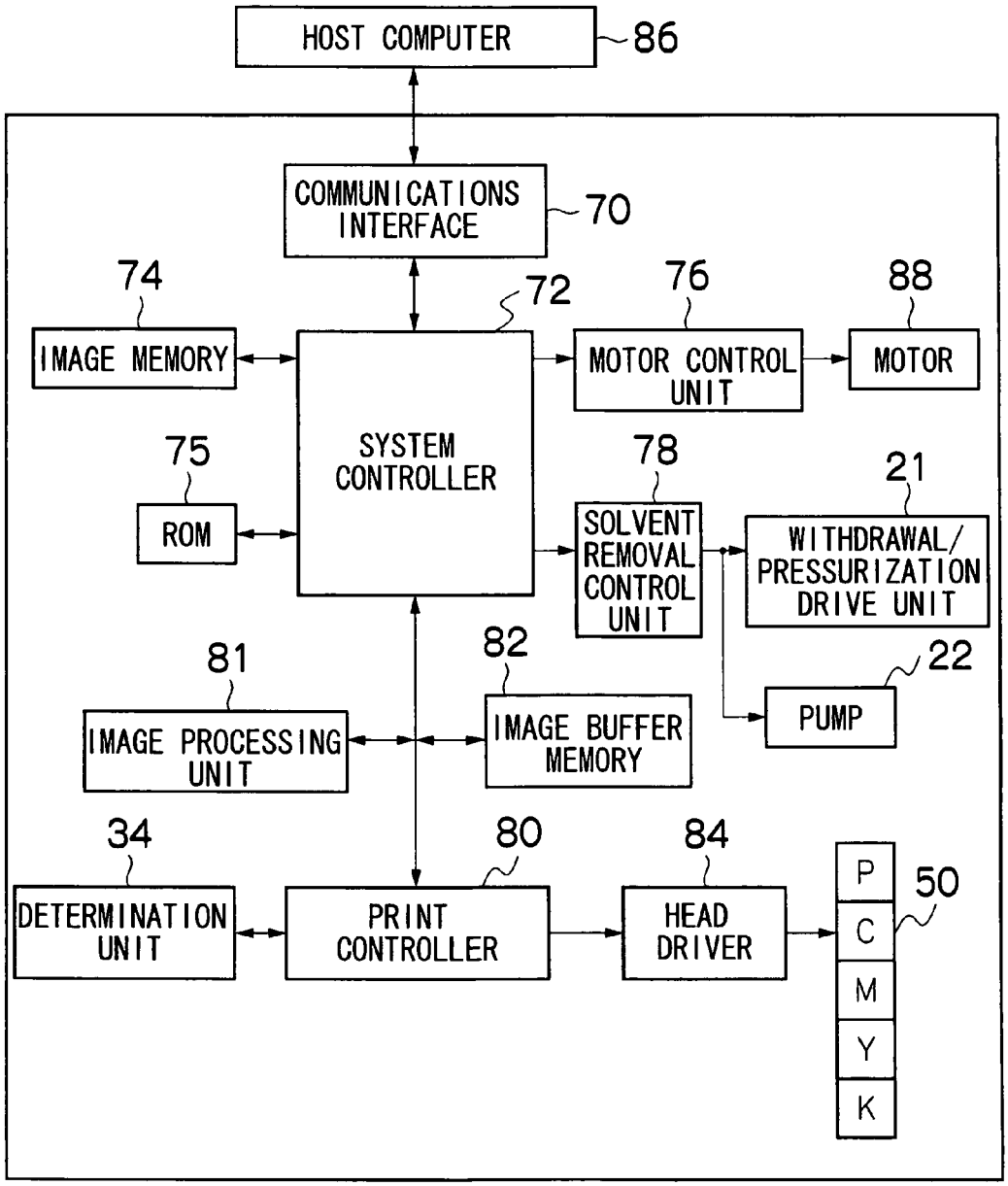
FIG. 6 is a principal block diagram showing a system configuration of the inkjet recording apparatus shown in FIG. 1.

Next, the control system of the inkjet recording apparatus 10 according to the present example is described below. FIG. 6 is a principal block diagram showing a system composition of the inkjet recording apparatus 10.

The inkjet recording apparatus 10 comprises a communications interface 70, a system controller 72, an image memory 74, a ROM 75, a motor controller 76, a solvent removal control unit 78, a print controller 80, an image processing unit 81, an image buffer memory 82, a head driver 84, and the like.

The communications interface 70 is an interface unit for receiving image data sent from a host computer 86. A serial interface such as USB (Universal Serial Bus), IEEE1394, Ethernet (registered trademark), wireless network, or a parallel interface such as a Centronics interface may be used as the communications interface 70. A buffer memory may be mounted in this portion in order to increase the communication speed. The image data sent from the host computer 86 is received by the inkjet recording apparatus 10 through the communications interface 70, and is temporarily stored in the image memory 74. The image memory 74 is a storage device for temporarily storing image data inputted through the communications interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor control unit 76, the solvent removal control unit 78, and the like. The system controller 72 is constituted by a central processing unit (CPU) and peripheral circuits relating to the CPU, and the like, and as well as controlling communications with the host computer 86, and reading and writing operations to and from the image memory 74, and the like. The system controller 72 also generates control signals for controlling the conveyance system (including the drive system of the intermediate transfer body 14 in FIG. 1, and the like), the motors 88 of the drive systems (including the drive system of the solvent removal unit 18 in FIG. 1, and the drive system of the movement mechanism for the blade 66 in FIG. 5), and the pump 22 of the solvent removal unit 18 (see FIG. 1).

The motor control unit 76 is a driver (drive circuit) which drives the motor 88 in accordance with instructions from the system controller 72. The motor 88 shown in FIG. 6 includes a plurality of motors, such as a motor forming a drive source for the drive rollers 15 shown in FIG. 1, a motor for the movement mechanism of the cap 64 shown in FIG. 5, and the like.

The solvent removal control unit 78 is a block which controls the withdrawal/pressurization drive unit 21 and the pump 22 of the solvent removal unit 18, in accordance with instructions from the system controller 72.

The print controller 80 is a control block which controls the blocks relating to image formation, in accordance with control instructions from the system controller 72. The print controller 80 has a memory controller function for presenting the image data in the image memory 74 to the image processing unit 81, a function of determining the speed (speed variation) information relating to the intermediate transfer body (see FIG. 1) obtained by the determination unit 34. The print controller 80 includes a counter for counting the number of times that a line pattern has been read in by the determination unit 34, and a memory which stores the value of the counter. The print controller 80 also has a function of incrementing the counter value each time that the determination unit 34 reads in a pattern of the line pattern 100, storing the counter value in the memory, and then calculating the movement distance of the intermediate transfer body 14 from the counter value stored in the memory.

The print controller 80 has a function for generating an ejection control signal which controls the ejection timings of the respective heads, on the basis of the speed information and the movement distance information relating to the intermediate transfer body 14.

The image processing unit 81 is attached to the print controller 80, and forms a signal processing block which carries out various processes in order to generate drive waveforms on the basis of image data supplied from the image buffer memory 82.

The print controller 80 controls the ejection volumes and the ejection timings of the inks and the treatment liquid ejected from the respective heads 50, via the head driver 84, on the basis of the drive waveform generated from the image data processed by the image processing unit 81, and the ejection control signal generated on the basis of the speed information and movement distance information relating to the intermediate transfer body 14.

The print controller 80 is provided with the image buffer memory 82. Image data, parameters, and other data are temporarily stored in the image buffer memory 82 when image data is processed in the print controller 80. It is also possible to use the image buffer memory 82 as a memory for storing the counter value as described above.

The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric elements 58 (see FIG. 4) of the heads 50 on the basis of the drive waveform and a trigger signal supplied by the print controller 80. A feedback control system for maintaining constant drive conditions for the heads may be included in the head driver 84.

A program storage unit (not illustrated) stores control programs for the inkjet recording apparatus 10, and the system controller 72 reads out the various control programs stored in the program storage unit, as and when appropriate, and executes the control programs.

Description of Ejection Control

Figure 7:
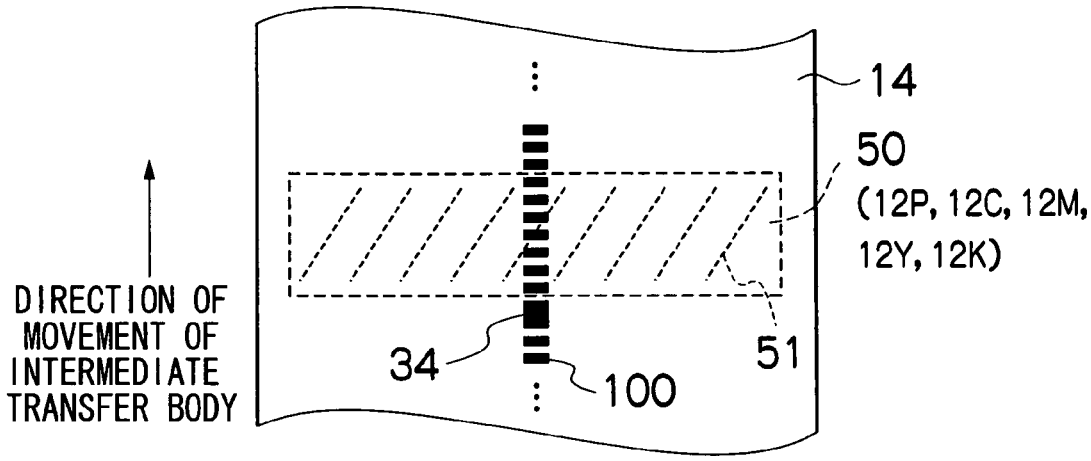
FIG. 7 is a perspective plan diagram of the intermediate transfer body shown in FIG. 1.

Next, the ejection control of the head 50 is described below. FIG. 7 is a plan diagram showing the intermediate transfer body 14 as viewed from the side of the inner surface. A line pattern 100 is provided on the inner surface of the intermediate transfer body 14, following the direction of movement of the intermediate transfer body, in a central position in terms of the breadthways direction of the intermediate transfer body (in other words, the main scanning direction), which is perpendicular to the direction of movement of the intermediate transfer body. FIG. 7 shows only a portion of the line pattern 100, but the line pattern 100 is in fact formed about the whole circumference of the intermediate transfer body 14.

The positions of the heads 50 and the intermediate transfer body 14 are adjusted in such a manner that the approximate central portion of the head 50 (12P, 12C, 12M, 12Y, 12K) indicated by the rectangular dotted line shape in FIG. 7 corresponds to the position where the line pattern 100 is formed. The dotted lines running in the oblique direction in FIG. 7 are schematic representations of the nozzle arrangement in the head 50.

In other words, the line pattern 100 is provided following the direction of movement of the intermediate transfer body, on the rear side of the image forming surface of the intermediate transfer body 14, so as to correspond to the ejection region of the print unit 12 (head 50) or the central portion of the image forming region on the intermediate transfer body 14 in terms of the direction perpendicular to the direction of movement of the intermediate transfer body.

Furthermore, the line pattern 100 has reflective properties whereby it reflects light when light is radiated thereon, and it uses a non-light transmission material which does not transmit light (or which transmits only a small amount of light) in at least the portion of the intermediate transfer body 14 where the line pattern 100 is provided and the vicinity of same.

Figure 8:
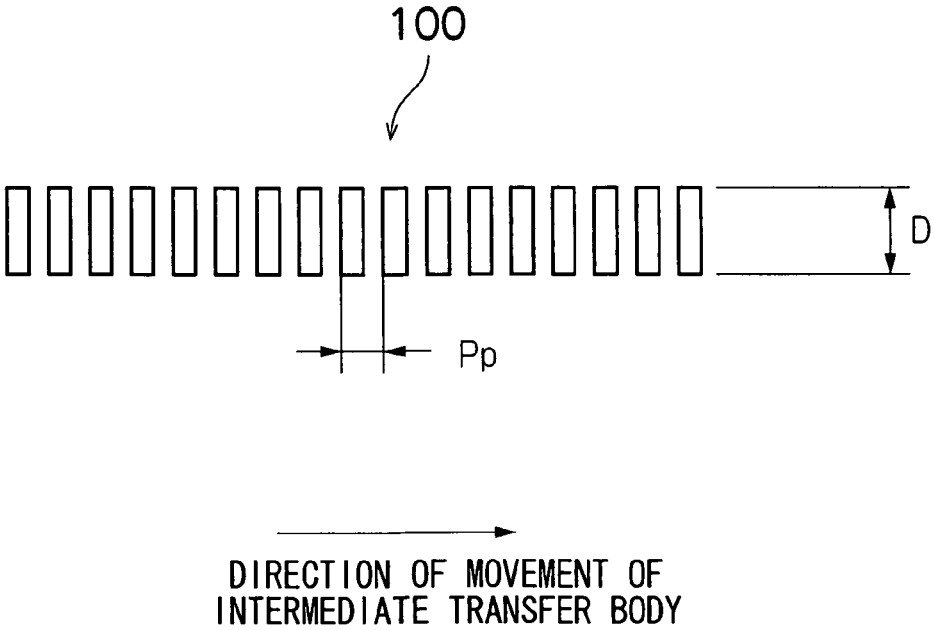
FIG. 8 is an enlarged view of the line pattern shown in FIG. 7.

FIG. 8 shows an enlarged view of the line pattern 100 in FIG. 7. The line pattern 100 is arranged at equidistant intervals (an arrangement pitch of $P_p$). The movement resolution of the intermediate transfer body 14 (the minimum movement distance; in other words, the minimum dot pitch in the direction of movement of the intermediate transfer body), and the arrangement intervals between the heads 12P, 12C, 12M, 12Y and 12K are decided on the basis of the arrangement pitch $P_p$ of the pattern constituting the line pattern 100.

In other words, the minimum dot pitch in the direction of movement of the intermediate transfer body is decided so as to be 1/n (where n is an integer) of the arrangement pitch $P_p$ of the pattern constituting the line pattern 100, and the arrangement interval between the heads 12P, 12C, 12M, 12Y and 12K is decided so as to be a factor of m times the arrangement pitch $P_p$ of the pattern constituting the line pattern 100 (where m is an integer equal to or greater than 2). Furthermore, in a more desirable configuration, the length of each pattern in the direction of movement of the intermediate transfer body is set to be one half of the arrangement pitch $P_p$ of the pattern, since this enables either the timings that reflected light from the pattern is determined or the timings that reflected light is not determined to be used for the control signals.

To give one example, the arrangement pitch $P_p$ of the line pattern 100 may be 42.3 μm (600 lpi). Furthermore, the width D of the pattern constituting the line pattern 100 has a sufficiently broad width with respect to the reading portion of the sensor (not illustrated in FIG. 8 and depicted as a photointerrupter indicated by reference numeral 120 in FIG. 9). It is suitable to use a high-precision processing technique, such as a printing method, or the like, in order to form the line pattern 100.

Figure 9:
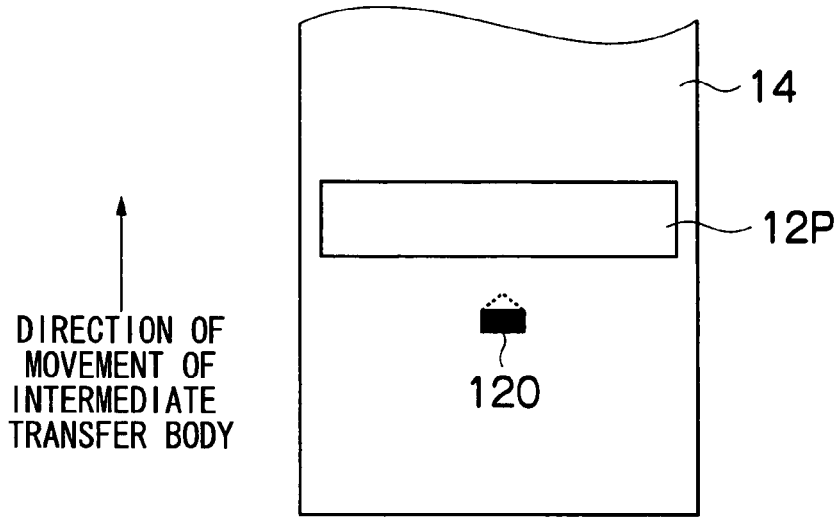
FIG. 9 is a diagram showing an example of the arrangement of the determination unit shown in FIG. 1.

FIG. 9 shows an example of the arrangement of the photointerrupter 120, which is a sensor (determination element) for reading in the line pattern 100 shown in FIG. 7 and FIG. 8.

The photointerrupter 120 shown in FIG. 9 is contained in the determination unit 34 shown in FIG. 1 and FIG. 6, and at least one such photointerrupter 120 is provided to the inner side of the intermediate transfer body 14, in a central position with respect to the direction perpendicular to the direction of movement of the intermediate transfer body 14. The light receiving surface of the photointerrupter 120 is provided so as to face the line pattern 100. Furthermore, the distance in the direction of movement of the intermediate transfer body between the photointerrupter 120 and the nozzles 51 of the treatment liquid head 12P on the furthest upstream side of the print heads 12 should be set to an integral multiple of the pattern arrangement pitch $P_p$ of the line pattern 100.

The photointerrupter 120 reads in light reflected by the line pattern 100, and outputs output signals (see FIGS. 11A to 11C and FIGS. 12A to 12C) which correspond to the light thus read in. The output signals of the photointerrupter 120 are supplied to the print controller 80 shown in FIG. 6, after being subjected to prescribed signal processing steps, such as noise removal, amplification, waveform shaping, and the like.

Figure 10:
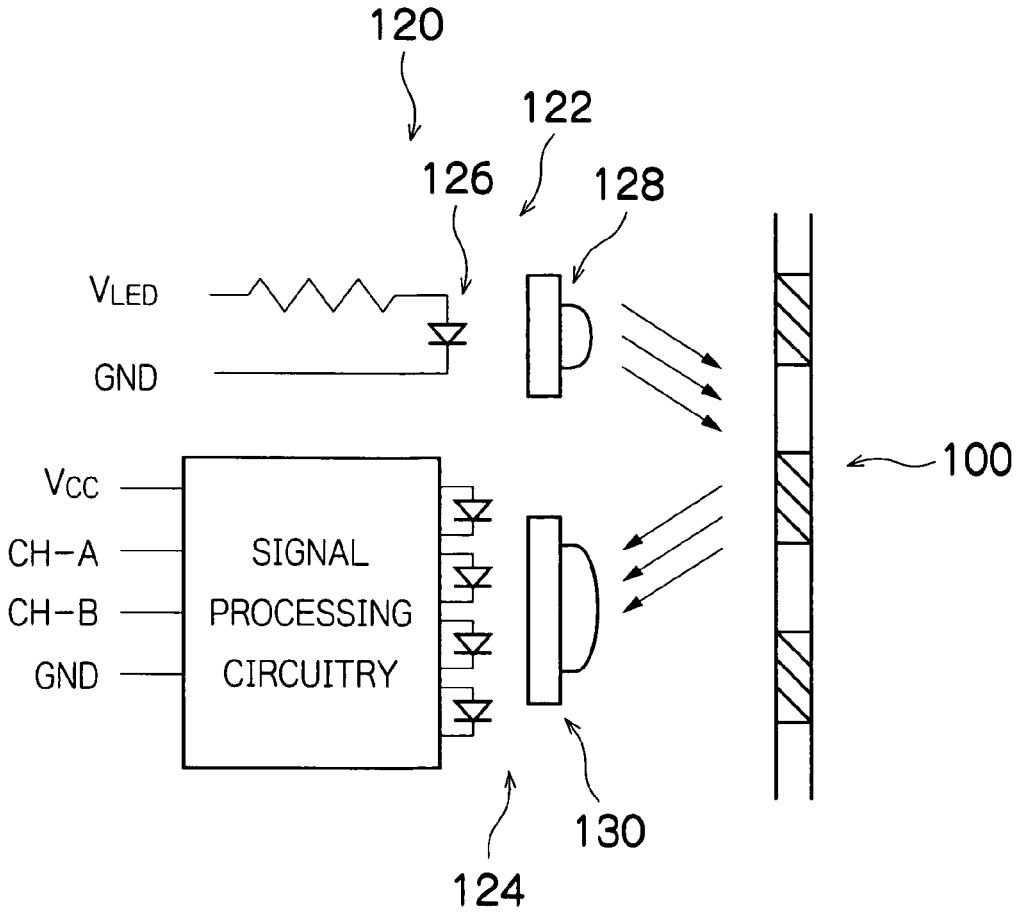
FIG. 10 is a diagram illustrating composition of the photointerrupter shown in FIG. 7.

FIG. 10 shows an example of the composition of the photointerrupter 120. As shown in FIG. 10, the photointerrupter 120 includes a light-emitting unit 122 (light-emitting element 128) which radiates light onto the line pattern 100, and a light-receiving unit 124 (light-receiving element 130) which receives light reflected by the line pattern 100.

Light is emitted from the light-emitting element 128 of the light-emitting unit 122, and when the light reflected by the line pattern 100 is then received by the light-receiving element 130, determination signals corresponding to this light reception are output from signal outputs CH-A and CH-B. The signal output CH-A outputs a uniform level signal while reflected light is determined, and the signal output CH-B outputs a signal delayed by ¼ of a cycle. By means of the output signal CH-B which is delayed by ¼ of a cycle, it is possible to confirm the direction in which the line pattern (intermediate transfer body) is moving.

FIGS. 11A to 11C and FIGS. 12A to 12C show examples of the output signals of the photointerrupter 120, and the drive signals for the piezoelectric elements 58 (see FIG. 4) corresponding to these output signals.

Figures 11A, 11B, 11C:
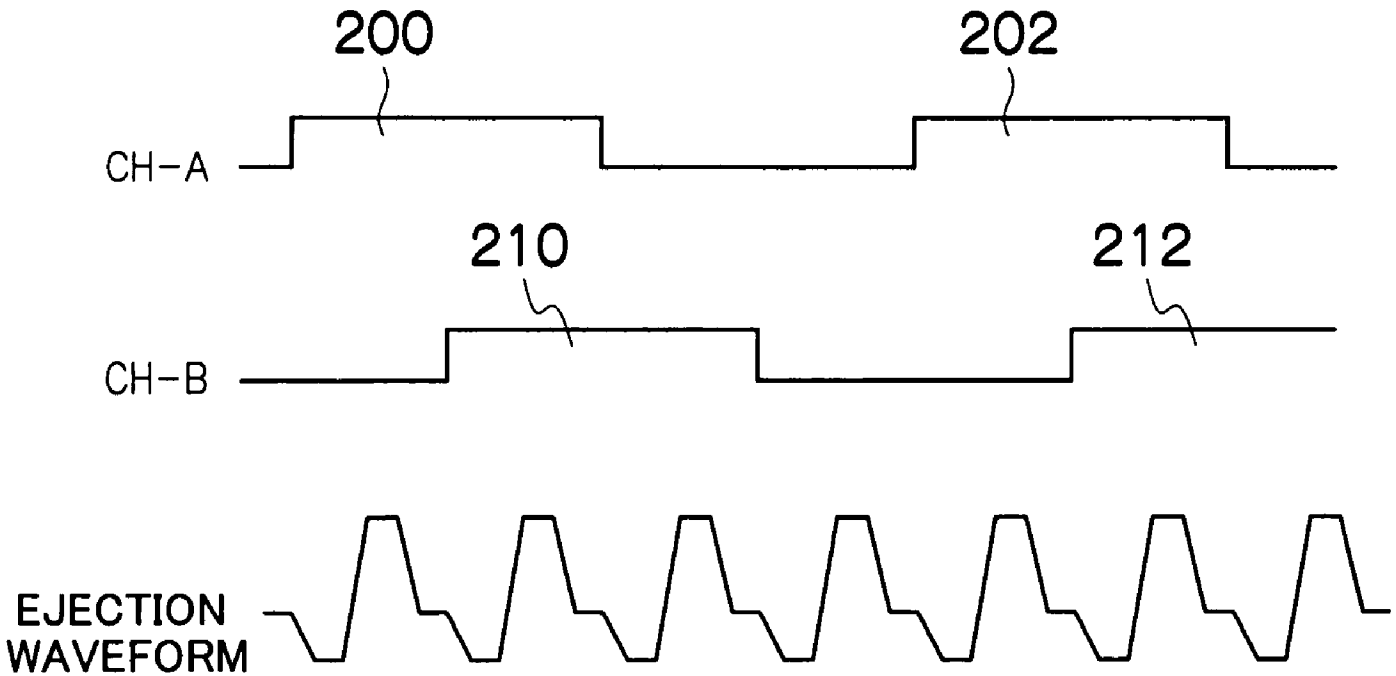
FIGS. 11A to 11C are diagrams showing output signals and an ejection waveform in a case where there is no speed variation.

FIGS. 11A and 11B show 2-phase output signals CH-A and CH-B which are output from the photointerrupter 120 in a case where the intermediate transfer body 14 moves at a uniform speed without any speed variations, and FIG. 11C is a waveform of a drive signal (ejection waveform) for a piezoelectric element 58 corresponding to the output signals CH-A and CH-B shown in FIGS. 11A and 11B. FIG. 11C shows an example of the ejection waveform for performing a pull-push driving operation, but it is also possible to employ another type of waveform.

The rising edge and the falling edge of the output signal CH-A and the output signal CH-B correspond to the ejection timings. If the intermediate transfer body 14 moves at a uniform speed without speed variations in the determination region of the determination unit 34, then the output signal CH-A and the output signal CH-B are uniform, without having any variation in pulse width and frequency, and the pulse width and time interval between pulses are the same. In other words, the pulse widths of the first waveform 200 and the second waveform 202 of the output signal CH-A are the same, and the time interval between the first waveform 200 and the second waveform 202 is the same as the time interval between the second waveform 202 and the third waveform (not illustrated) which follows the second waveform 202.

Similarly, the pulse widths of the first waveform 210 and the second waveform 212 of the output signal CH-B are the same, and the time interval between the first waveform 210 and the second waveform 212 is the same as the time interval between the second waveform 212 and the third waveform (not illustrated) which follows the second waveform 212.

Consequently, in a case where the intermediate transfer body 14 moves at a uniform speed without speed variations in the determination region of the determination unit 34, the frequency of the ejection timings (in other words, the ejection frequency) is also uniform, and ink is ejected from the nozzles on the basis of these ejection timings.

Figures 12A, 12B, 12C:
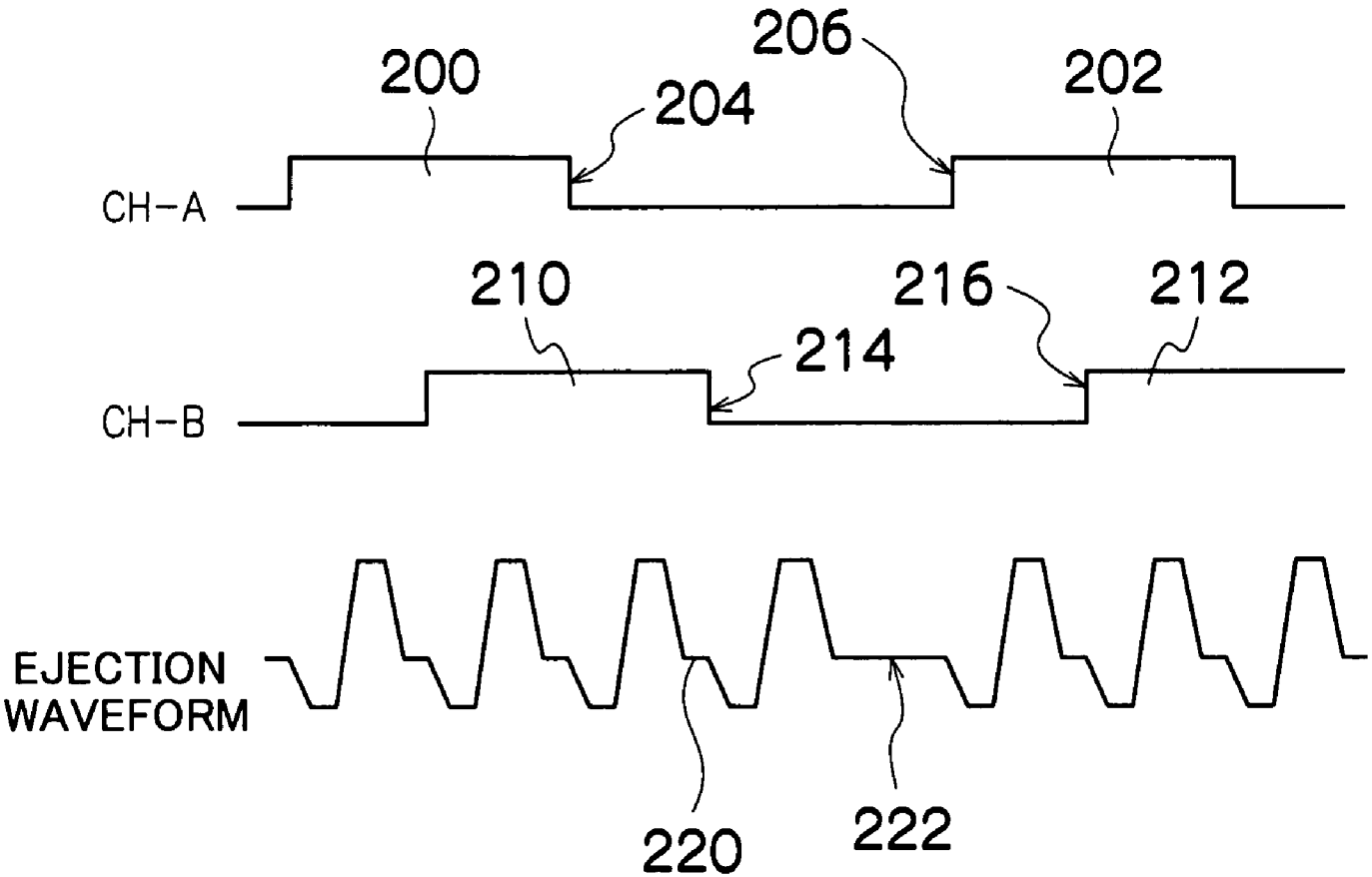
FIGS. 12A to 12C are diagrams showing output signals and an ejection waveform in a case where there is speed variation.

On the other hand, FIGS. 12A to 12C show the output signals CH-A, CH-B and ejection waveform in a case where speed variation does occur in the intermediate transfer body 14 in the determination region of the determination unit 34. When speed variation occurs in the intermediate transfer body 14, there is a change in the output timings of the output signals CH-A and CH-B which correspond to the position where the speed variation occurred. For example, the time interval between the falling edge 204 of the first waveform 200 and the rising edge 206 of the second waveform 202 of the output signal CH-A shown in FIG. 12A, becomes longer than the prescribed time interval shown in FIG. 11A. Furthermore, in a similar fashion, the time interval between the falling edge 214 of the first waveform 210 of and the rising edge 216 of the second waveform 212 the output signal CH-B shown in FIG. 12B, becomes longer than the prescribed time interval shown in FIG. 11B.

In a case where output waveforms CH-A and CH-B of this kind are obtained, since the rising edge and the falling edge of the output signal CH-A and the output signal CH-B are taken as ejection timings, then the ejection timings of the heads are decided in accordance with the speed variation of the intermediate transfer body 14, as shown in FIG. 12C. If a speed delay occurs in the intermediate transfer body 14, and if ejection continues at a uniform frequency, then the depositing positions on the intermediate transfer body 14 may become overlapping and the image quality deteriorates markedly. However, by controlling ejection on the basis of the movement speed and the movement distance of the intermediate transfer body 14, the ejection interval indicated by reference numeral 222 becomes longer than the ejection interval indicated by reference numeral 220, in accordance with the delay in the determination interval of the line pattern 100, and therefore the ejection timing is slowed in synchronism with the slowing of the speed of the intermediate transfer body 14. Consequently, it is possible to prevent displacement of the depositing positions of the liquid on the intermediate transfer body 14, and a desirable image is formed which is free of quality degradation caused by displacement of the dot positions.

Figure 13:
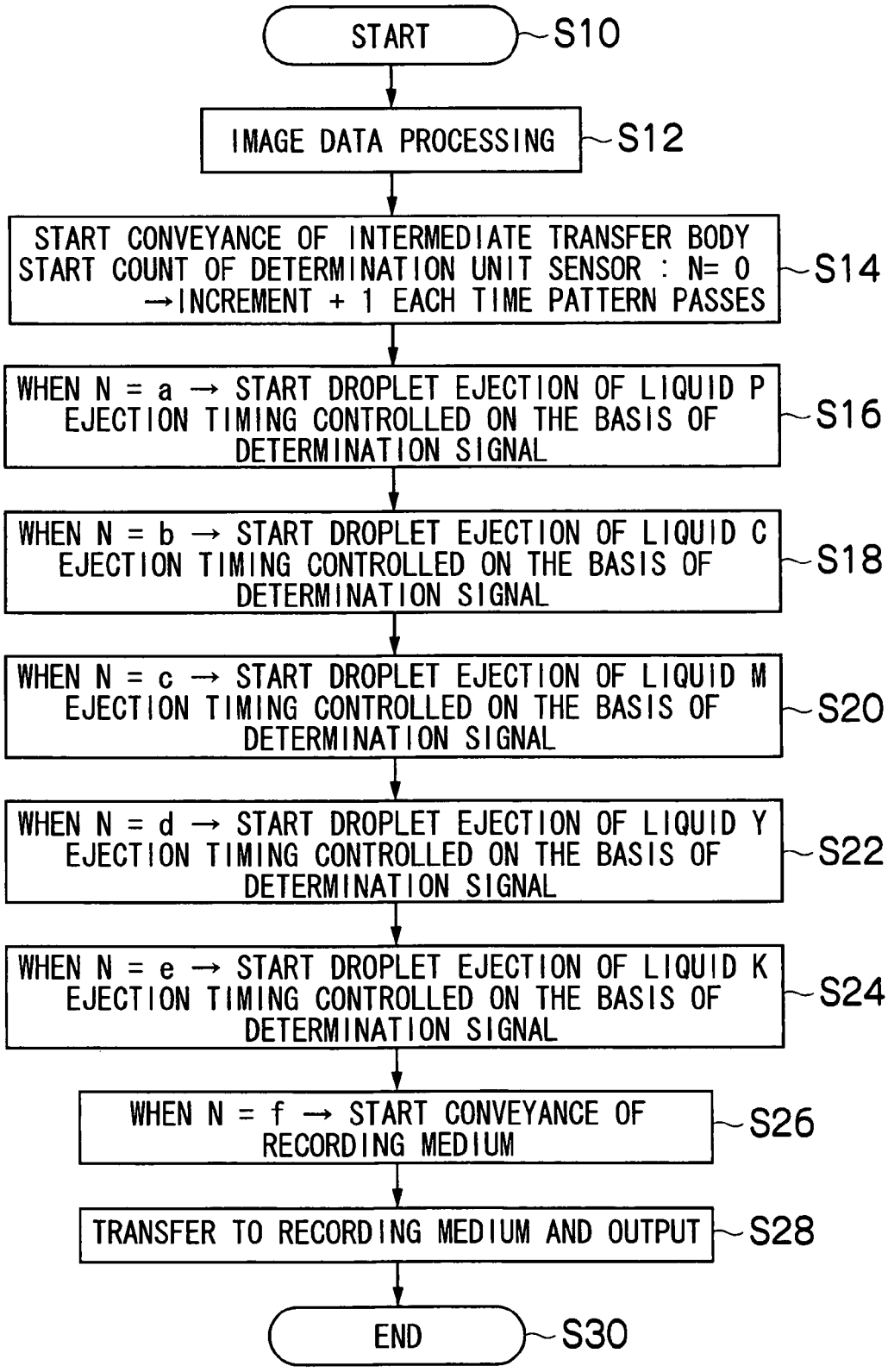
FIG. 13 is a flowchart showing a sequence of ejection control according to an embodiment of the present invention.

FIG. 13 is a flowchart of the control of image forming (ejection control) according to the present example. When image formation control starts (step S10), image data is acquired and an ejection control signal is generated by means of prescribed image processing (step S12).

Thereupon, the conveyance of the intermediate transfer body 14 is started and the determination of the line pattern by the determination unit 34 is started (step S14). In the present image formation control procedure, the positions of the print unit 12, the solvent removal unit 18, and the transfer unit 26 are judged from the photointerrupter 120, on the basis of the counter value N of the counter which counts the number of reading operations of the line pattern 100 (in other words, the distance of movement of the intermediate transfer body 14 is calculated from the position of the photointerrupter 120).

In the inkjet recording apparatus 10, by making the arrangement interval between the heads 12P, 12C, 12M, 12Y and 12K equal to an integral multiple of the arrangement pitch of the line pattern 100 (see FIG. 8), as well as providing the line pattern 100 on the full circumference of the intermediate transfer body 14, it is possible accurately to calculate the relative positions, with respect to the photointerrupter, of the sections other than the print unit 12, such as the solvent removal unit 18, the transfer unit 26 and the cleaning device. The counter which counts the number of reading operations of the line pattern 100 is provided in the control system shown in FIG. 6 (for example, in the print controller 80).

At step S14 in FIG. 13, when determination of the line pattern 100 is started, a value of 0 is substituted for the counter value N of the counter described above, and each time one pattern of the line pattern 100 passes the photointerrupter 120, the value of the counter is incremented by 1.

When the counter value N becomes a value "a" corresponding to the position of the treatment liquid head 12P, then ejection of treatment liquid is carried out (step S16) on the basis of the ejection timing determined from the output signal CH-A and the output signal CH-B of the photointerrupter 120, and the procedure then advances to step S118.

At step S18, when the counter value N becomes a value "b" corresponding to the position of the C head 12C, then ejection of C ink is carried out on the basis of the ejection timing determined from the output signal CH-A and the output signal CH-B of the photointerrupter 120, and the procedure then advances to step S20.

At step S20, when the counter value N becomes a value "c" corresponding to the position of the M head 12M, then ejection of M ink is carried out on the basis of the ejection timing determined from the output signal CH-A and the output signal CH-B of the photointerrupter 120, and the procedure then advances to step S22.

At step S22, when the counter value N becomes a value "d" corresponding to the position of the Y head 12Y, then ejection of Y ink is carried out on the basis of the ejection timing determined from the output signal CH-A and the output signal CH-B of the photointerrupter 120, and the procedure then advances to step S24.

At step S24, when the counter value N becomes a value "e" corresponding to the position of the K head 12K, ejection of K ink is carried out on the basis of the ejection timing determined from the output signal CH-A and the output signal CH-B of the photointerrupter 120.

In this way, when a desired image has been formed on the image forming region of the intermediate transfer body 14 by ejecting the treatment liquid and C, M, Y and K inks, the intermediate transfer body 14 is moved further, and when the counter value N becomes a value corresponding to the position of the solvent removal unit 18, the solvent removal unit 18 is operated and excess solvent is removed from the intermediate transfer body 14.

When the intermediate transfer body 14 is moved further and the counter value N becomes a value "f" corresponding to the position of the transfer unit 26, then a recording medium 16 is supplied to the transfer unit 26 from the paper supply unit 28 (step S26).

When the recording medium 16 is supplied to the transfer unit 26, the image formed on the intermediate transfer body 14 is transferred to the recording medium 16, and the recording medium 16 on which the desired image has been formed is then output by means of the output roller 32 (step S28). When the transfer step in step S28 has been completed, the ink and solvent remaining on the image forming region of the intermediate transfer body 14 is removed by means of the cleaning device.

The processes from the step S14 to the step S28 described above are repeated until there is no more image data, and if there is no more image data, then the ejection control procedure terminates (step S30).

In the inkjet recording apparatus 10 having the composition described above, even if speed variation occurs in the intermediate transfer body 14 due to variations in the load on the intermediate transfer body 14 during the transfer step (step S28), or the recording medium separating step, intermediate transfer body cleaning step, or the like, the ejection timings of the heads 12P, 12C, 12M, 12Y and 12K are decided in accordance with the speed variation of the intermediate transfer body directly below the inkjet head; therefore, it is possible to form an image in which there is no disturbance to the depositing positions on the intermediate transfer body 14, even during the execution of a transfer step or an intermediate transfer body cleaning step, and it is possible to form an image stably, without causing a decline in productivity and without deterioration of image quality.

Furthermore, by providing the line pattern 100 in the central portion of the intermediate transfer body in the breadthways direction perpendicular to the direction of movement of the intermediate transfer body, and on the rear side of the image forming surface of the intermediate transfer body 14, it is possible to minimize the overall error in the ejection timings of the respective nozzles of the heads 12P, 12C, 12M, 12Y and 12K caused by variation in the accuracy of the conveyance positions of the intermediate transfer body 14, and it is also possible to prevent soiling of the line pattern 100 as a result of ink or ink mist.

Figure 14:
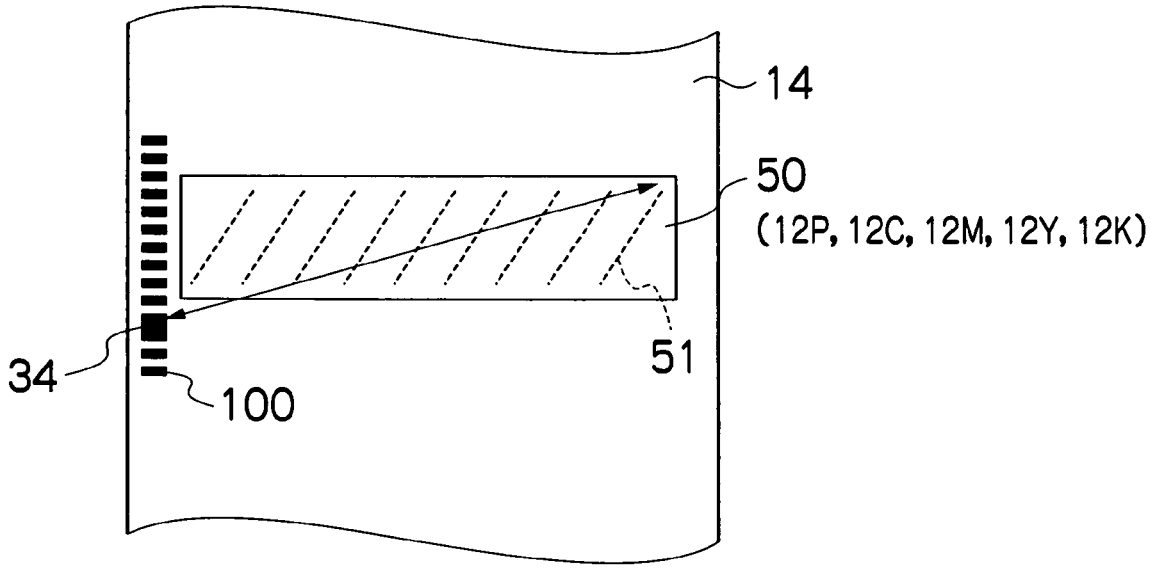
FIG. 14 is a diagram for describing another line pattern.

FIG. 14 shows a case where the line pattern is provided on the image forming surface of the intermediate transfer body. If the line pattern 100 is provided on the image forming surface of the intermediate transfer body 14, it must be disposed to the outer side of the image forming region, and therefore the line pattern 100 is provided in an edge portion of the intermediate transfer body 14 in terms of the breadthways direction, as shown in FIG. 14.

In other words, in the mode shown in FIG. 14, the distance between the line pattern 100 (the position of determination by the determination unit 34) and the edge portion on the opposite side to the line pattern 100 (this distance being indicated by the arrow) is greater than in the present example (approximately two times greater). Consequently, if the intermediate transfer body 14 travels in a skewed fashion, or if the intermediate transfer body 14 and the print unit 12 are assembled in an oblique fashion, then in the vicinity of the end portion on the opposite side to the line pattern 100, an error occurs with respect to the speed determined by the determination unit 34 and positional displacement occurs in the depositing positions from the nozzles. Therefore, if ejection is controlled by determining one line pattern, it is desirable that the line pattern 100 should be provided in the central portion of the intermediate transfer body in terms of the breadthways direction perpendicular to the direction of movement of the intermediate transfer body, as in the present example, and this can be achieved by providing the line pattern on the rear surface of the image forming surface.

Furthermore, as shown in FIG. 14, if the line pattern 100 is provided on the image forming surface of the intermediate transfer body 14, the line pattern 100 may be soiled by ink or ink mist to the outside of the image forming region; therefore, it is desirable to provide the line pattern 100 on the rear side of the image forming surface of the intermediate transfer body 14, as in the present example, in order to avoid soiling of the line pattern 100.

MODIFICATION EXAMPLE 1

Figure 15:
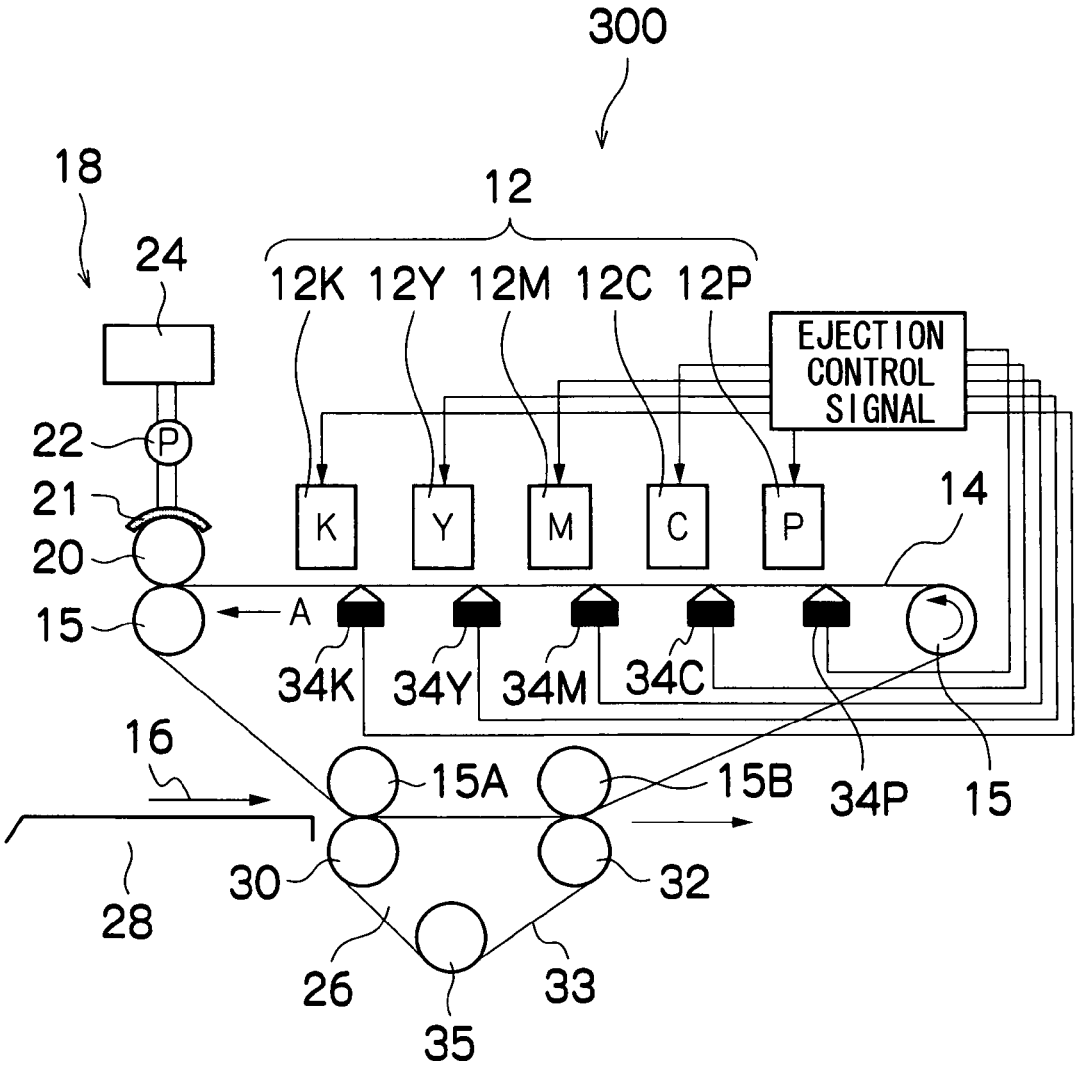
FIG. 15 is a basic schematic drawing of an inkjet recording apparatus relating to an application example of an embodiment of the present invention.

Next, a modification example of the above-described embodiment of the present invention is described below. FIG. 15 is a schematic drawing showing the composition of an inkjet recording apparatus 300 relating to the present modification example. In FIG. 15, items which are the same as or similar to those in FIG. 1 are labeled with the same reference numerals and description thereof is omitted here.

The inkjet recording apparatus 300 shown in FIG. 15 comprises determination units 34P, 34C, 34M, 34Y and 34K provided for the head 12P which ejects the treatment liquid, and the heads 12C, 12M, 12Y and 12K corresponding to the inks of C, M, Y and K, on the upstream side of each in terms of the direction of movement of the intermediate transfer body.

In other words, the determination unit 34P is disposed in the vicinity of the treatment liquid head 12P, the determination unit 34C corresponding to the C ink head 12C is disposed between the treatment liquid head 12P and the C ink head 12C, and similarly, the determination unit 34M corresponding to the M ink head 12M is disposed between the C ink head 12C and the M ink head 12M, the determination unit 34Y corresponding to the Y ink head 12Y is disposed between the M ink head 12M and the Y ink head 12Y, and the determination unit 34K corresponding to the K ink head 12K is disposed between the Y ink head 12Y and the K ink head 12K.

In other words, the arrangement interval between the heads 12P, 12C, 12M, 12Y and 12K and the determination units 34P, 34C, 34M, 34Y and 34K corresponding respectively to the heads is smaller than the arrangement pitch between the heads 12P, 12C, 12M, 12Y and 12K.

Similarly to the mode shown in FIG. 1, the determination units 34P, 34C, 34M, 34Y and 34K corresponding to the heads 12P, 12C, 12M, 12Y and 12K are provided in the central region of the intermediate transfer body 14 in terms of the breadthways direction of same, to the inner side of the intermediate transfer body 14, and they are disposed in such a manner that the determination units (light-receiving unit of the photointerrupter) face the line pattern 100 shown in FIG. 7.

Furthermore, similarly to the mode shown in FIG. 1, the arrangement pitch of the heads 12P, 12C, 12M, 12Y and 12K is an integral multiple of the pattern arrangement pitch $P_p$ of the line pattern 100 (see FIG. 8), and moreover, the arrangement interval between the determination units 34P, 34C, 34M, 34Y and 34K is also an integral multiple of the pattern arrangement pitch $P_p$ of the line pattern 100. In this way, in a mode where determination units 34P, 34C, 34M, 34Y and 34K are provided respectively to correspond to the heads 12P, 12C, 12M, 12Y and 12K, the ejection timings of the nozzles of the heads 12P, 12C, 12M, 12Y and 12K are controlled accurately in accordance with the movement of the intermediate transfer body, and even if there is a speed variation in the intermediate transfer body, the reaction between the treatment liquid and the ink is performed reliably and color bleeding is prevented.

Figure 16:
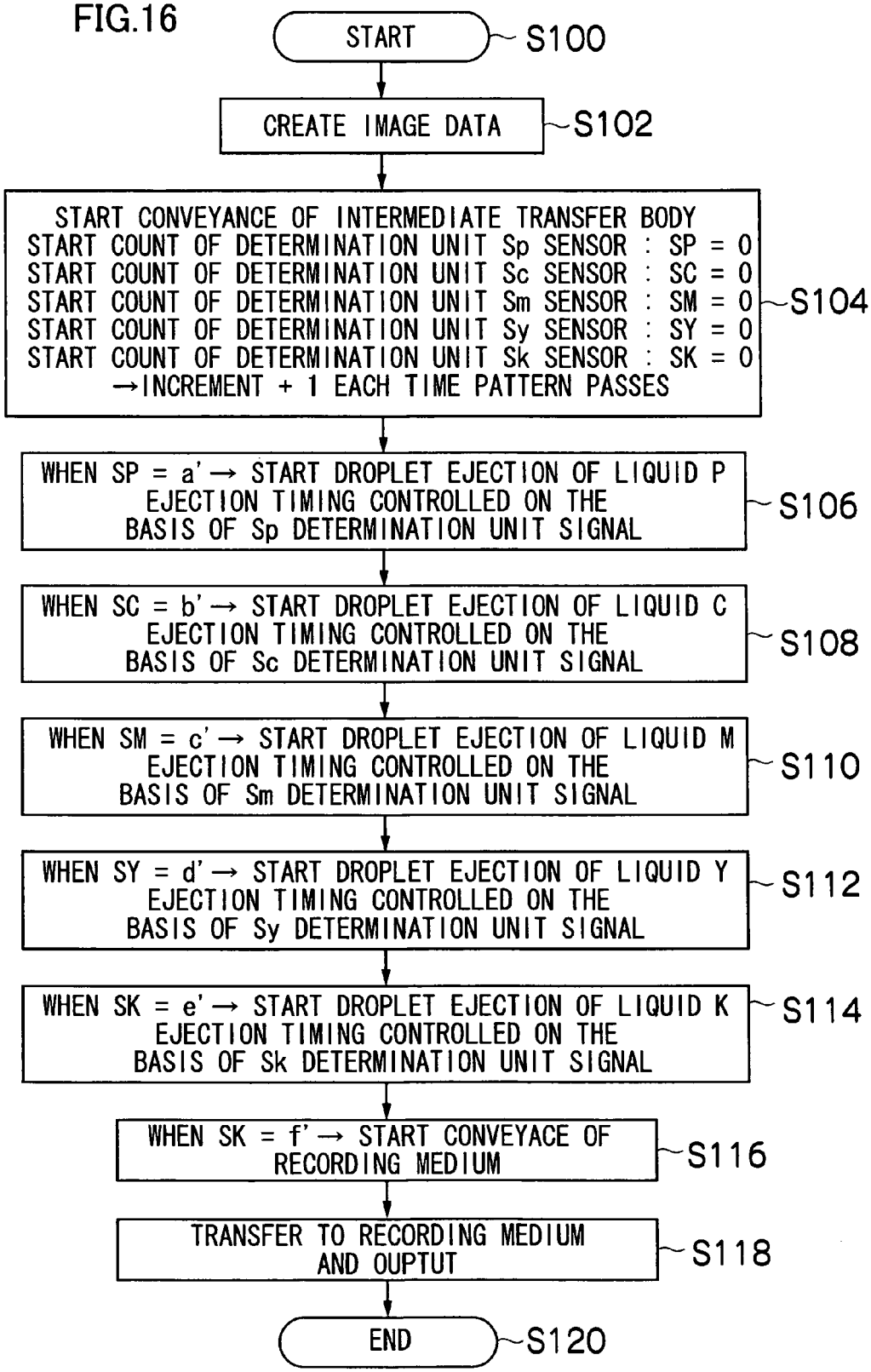
FIG. 16 is a flowchart showing the sequence of ejection control in the inkjet recording apparatus shown in FIG. 15.

FIG. 16 shows a flowchart of ejection control in the mode where determination elements corresponding to the respective heads are provided.

As shown in FIG. 16, when the image formation control starts (step S100), image data is created (step S102).

Thereupon, the conveyance of the intermediate transfer body 14 is started, and furthermore, determination of the line pattern 100 is started by the determination units 34P (Sp), 34C(Sc), 34M(Sm), 34Y(Sy), 34K(Sk), which correspond to the respective heads 12P, 12C, 12M, 12Y and 12K (step S14).

When the determination of the line pattern 100 is started, the counter values SP, SC, SM, SY and SK of the determination units Sp, Sc, Sm, Sy, Sk described above are set to the value 0, and each of the counter values SP, SC, SM, SY and SK is incremented each time one line pattern is read out (each time one line pattern passes the determination unit).

When the intermediate transfer body moves and the counter value SP becomes the value "a'" which corresponds to the position of the treatment liquid head 12P, the treatment liquid is ejected at an ejection timing determined on the basis of the determination signal from the determination unit Sp (step S106), and the procedure then advances to step S108.

At step S108, when the counter value SC has become a value "b'" which corresponds to the position of the C head 12C, C ink is ejected at an ejection timing determined on the basis of the determination signal from the determination unit Sc, and the procedure then advances to step S110.

At step S110, when the counter value SM has become a value "c'" which corresponds to the position of the M head 12M, M ink is ejected at an ejection timing determined on the basis of the determination signal from the determination unit Sm, and the procedure then advances to step S112.

At step S112, when the counter value SY has become a value "d'" which corresponds to the position of the Y head 12Y, Y ink is ejected at an ejection timing determined on the basis of the determination signal from the determination unit Sy, and the procedure then advances to step S114.

At step S114, when the counter value SK has become a value "e'" corresponding to the position of the K head 12K, then K ink is ejected at an ejection timing determined on the basis of the determination signal from the determination unit Sk.

In this way, when a desired image has been formed on the image forming region of the intermediate transfer body 14 by ejecting the treatment liquid and C, M, Y and K inks, the intermediate transfer body 14 is moved further, and when the counter value N of the determination unit Sk (the counter value from another determination unit may be used but the determination unit at the furthest downstream position is most desirable) becomes a value corresponding to the position of the solvent removal unit 18, the solvent removal unit 18 is operated and excess solvent is removed from the intermediate transfer body 14.

When the intermediate transfer body 14 is moved further and the counter value of the determination unit Sk becomes a value "f'" corresponding to the position of the transfer unit 26, then a recording medium 16 is supplied to the transfer unit 26 from the paper supply unit 28 (step S116). When the recording medium 16 is supplied to the transfer unit 26, the image formed on the intermediate transfer body 14 is transferred to the recording medium 16, and the recording medium 16 on which the desired image has been formed is then output by means of the output roller 32 (step S118). When the transfer step in step S118 has been completed, the ink and solvent remaining on the image forming region of the intermediate transfer body 14 is removed by means of the cleaning device. In the present example, a mode is described in which the transfer timing of the transfer unit is controlled on the basis of signal determination by the determination unit Sk, but it is also possible to provide a separate determination unit in the vicinity of the transfer unit and to use the determination signal from this unit in order to control the transfer timing.

The processes from the step S104 to the step S118 described above are repeated until there is no more image data, and if there is no more image data, then the ejection control procedure terminates (step S120).

According to the present application example, by providing determination units respectively for the heads, the error in the ejection timings corresponding to the nozzles of the respective heads is reduced and color bleeding in the image is prevented.

MODIFICATION EXAMPLE 2

Figure 17:
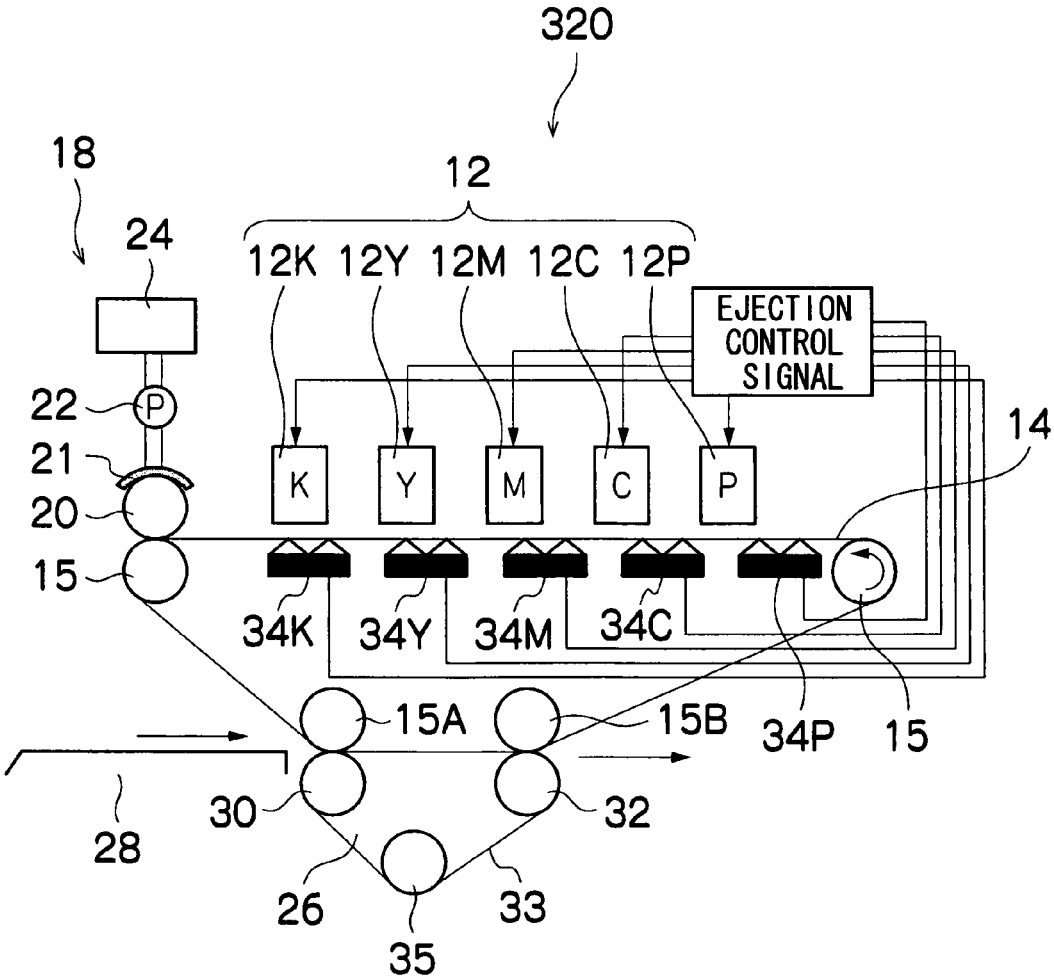
FIG. 17 is a basic compositional diagram showing a further mode of the inkjet recording apparatus shown in FIG. 15.

Moreover, a further modification example of the above-described embodiment of the present invention is also described below. FIG. 17 is a schematic drawing showing an inkjet recording apparatus 320 in which the determination units 34P, 34C, 34M, 34Y and 34K which correspond respectively to the heads 12P, 12C, 12M, 12Y and 12K each comprise a plurality of determination elements (photointerrupters).

In other words, since two determination elements per head are provided in the direction of movement of the intermediate transfer body 14 in the inkjet recording apparatus 320 shown in FIG. 17, then this is equivalent to arranging the patterns constituting the line pattern 100 at a pitch of $P_p/2$, and therefore it is possible to improve the accuracy of control.

Figure 18:
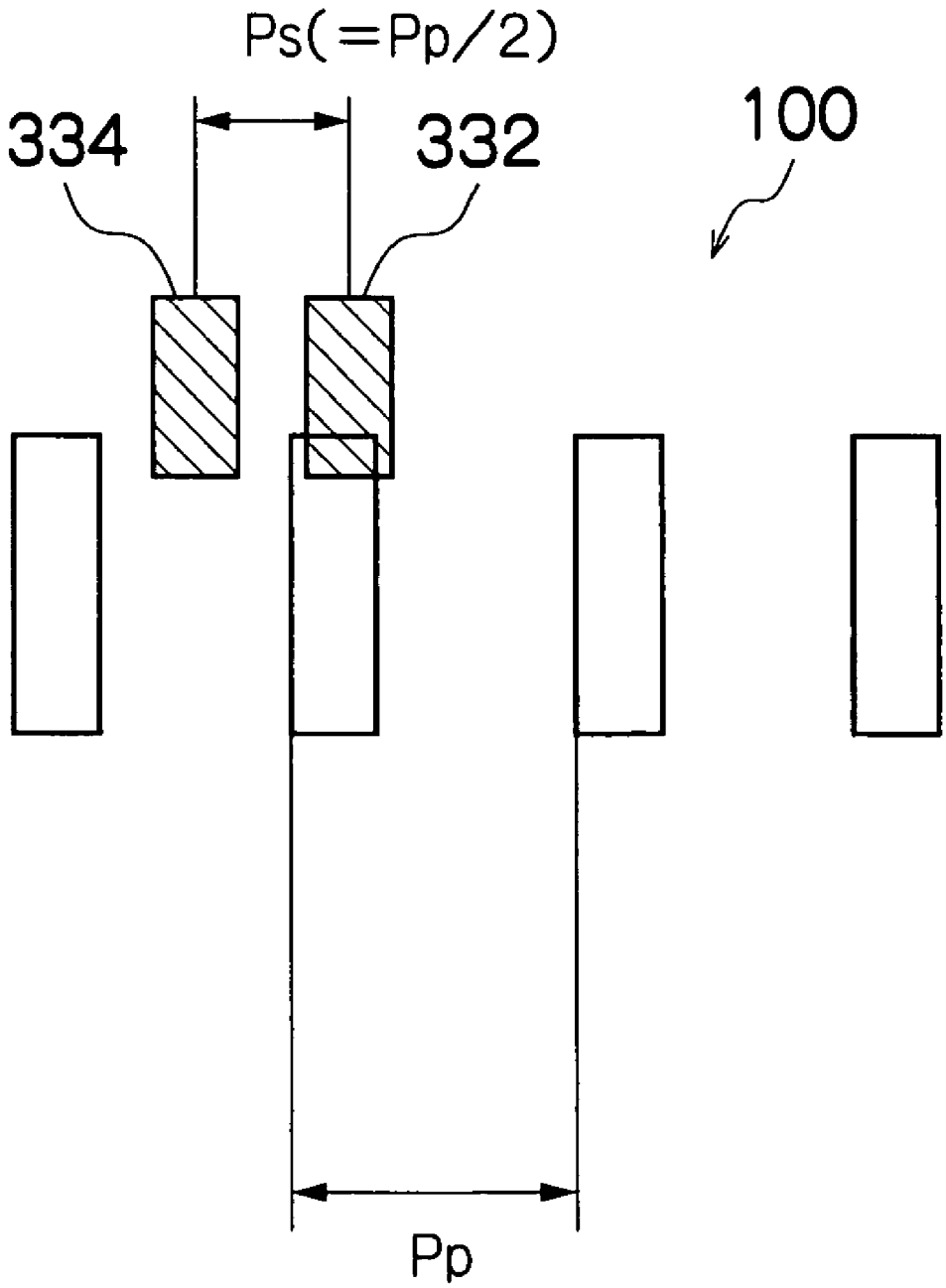
FIG. 18 is a diagram illustrating an arrangement of determination elements in the inkjet recording apparatus shown in FIG. 17.

FIG. 18 shows an example of the arrangement of two determination elements provided in relation to one head. In FIG. 18, in order to aid understanding, the line pattern 100 and the determination elements 332 and 334 are depicted in a staggered fashion in the vertical direction in FIG. 18.

As shown in FIG. 18, the arrangement pitch $P_s$ between the first determination element 332 and the second determination element 334 is ½ of the arrangement pitch $P_p$ of the line pattern 100. In other words, the determination element 332 and the determination element 334 are disposed in positions whereby the second determination element 334 determines a pattern of the line pattern 100 when the intermediate transfer body 14 has moved through a distance equivalent to ½ of the pitch since that pattern was determined by the first determination element 332. If two determination elements are arranged as shown in the drawing, then it is possible to control ejection at a frequency of four times the pitch of the pattern, simply by means of the CH-A and CH-B rise signals of the two determination elements.

In a mode of this kind, it is possible to control ejection with good accuracy, even if the length of the reflecting sections and the non-reflecting sections of the line pattern 100 in the direction of movement of the intermediate transfer body is not set precisely to ½ of the arrangement pitch $P_p$ of the pattern. Therefore, the manufacture of the line pattern can be simplified.

Furthermore, in a case where two determination elements 332 and 334 are arranged at an interval of ⅛ of the arrangement pitch $P_p$ of the line pattern 100, it is possible to improve the control resolution even further.

Figure 19:
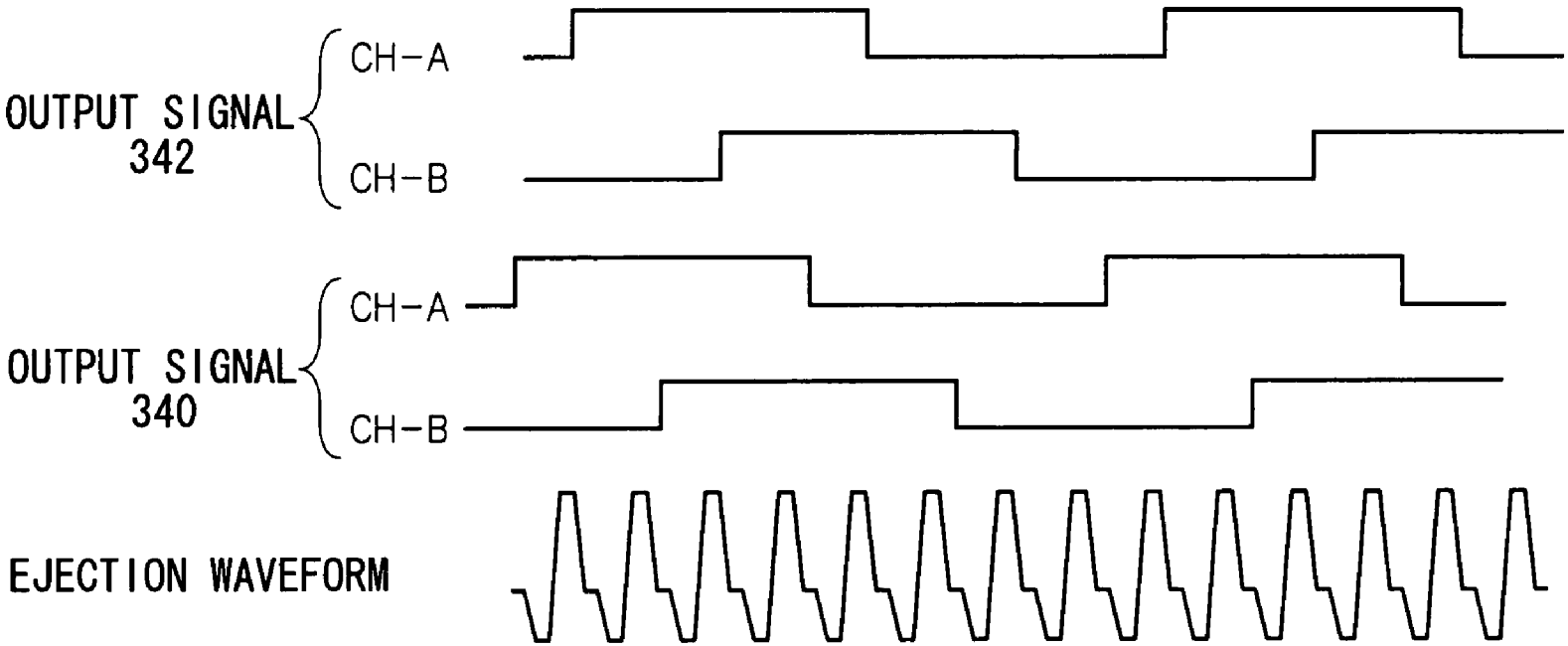
FIG. 19 is a diagram for describing the output signals of the determination elements shown in FIG. 18.

FIG. 19 shows waveforms of output signals 340 and 342 from the respective elements 332 and 334, and the ejection control signals corresponding to these, in a case where the first determination element 332 and the second determination element 334 are arranged at an interval of ⅛ of the arrangement pitch $P_p$ of the line pattern 100.

In a mode of this kind, both rising edges and falling edges of the determination signals are used. The control resolution is improved in comparison with a case where there is only one determination element 34 as shown in FIG. 1, and furthermore, in cases where it is necessary to raise the droplet ejection density, as in high-quality mode, for instance, displacement of the depositing positions at the respective droplet ejection points can be prevented and a high-quality image which is free of displacement in the dot positions can be formed.

MODIFICATION EXAMPLE 3

Figure 20:
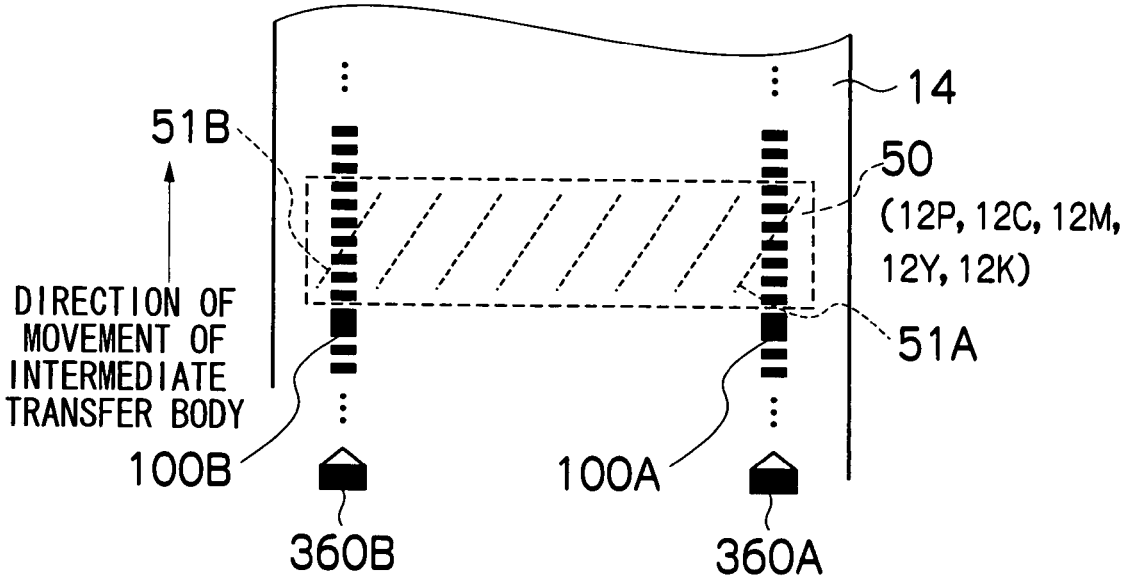
FIG. 20 is a diagram showing a further mode of the line pattern shown in FIG. 17.

Moreover, yet a further modification example of the above-described embodiment of the present invention is also described below. FIG. 20 is a plan diagram of the intermediate transfer body 14 as viewed from the inner surface side. On the inner surface of the intermediate transfer body 14, a line pattern 100A and a line pattern 100B are provided following the direction of movement of the intermediate transfer body, respectively in either edge portion of the image region in terms of the breadthways direction (in other words, the main scanning direction) which is perpendicular to the direction of movement of the intermediate transfer body. Furthermore, determination units 360A and 360B are provided respectively so as to correspond with the line pattern 100A and the line pattern 100B.

By providing the determination units 360A and 360B respectively in either edge portion of the image forming region, it is possible further to reduce ejection control errors relating to the nozzles caused by skewed travel of the intermediate transfer body 14, or the like, in comparison with a mode where the movement speed and the movement distance of the intermediate transfer body 14 are determined by means of a determination unit 34 (photointerrupter 120) provided in one location, as shown in FIG. 9. For example, control relating to the nozzles of the head 50 can be carried out by using the right-side determination unit 360A with respect to the right-hand side nozzles 51A in FIG. 20, and control can be carried out by using the left-side determination unit 360B with respect to the left-hand side nozzles 51B in FIG. 20. The amount of skew of the intermediate transfer body 14 may be calculated from the control signals from the two determination units 360A and 360B, and the ejection control may be corrected for skew of the intermediate transfer body 14, in respect of the ejection positions of each nozzle.

MODIFICATION EXAMPLE 4

Moreover, a further modification example of the above-described embodiment of the present invention is also described below. The above-described examples have been described with respect to a mode where the treatment liquid head 12P and the heads 12C, 12M, 12Y and 12K corresponding to the colors of C, M, Y and K have the same structure; however, depending on the system employed, there is also a mode in which the same level of depositing accuracy is not required for the treatment liquid as for the C, M, Y and K inks. In this case, it is possible to lower the nozzle density and the nozzle formation accuracy of the treatment liquid head 12P in comparison with the heads 12C, 12M, 12Y and 12K corresponding to the C, M, Y and K inks. Furthermore, instead of using the treatment liquid head 12P, it is also possible to apply the treatment liquid to the image forming region of the intermediate transfer body 14 by using an application member, such as an application roller, blade, or the like.

In a mode of this kind, it is also possible to adopt a composition in which a determination unit 34 is provided between the treatment liquid head 12P and the C ink head 12C (namely, the head on the furthest upstream position of the C, M, Y and K ink heads in terms of the direction of movement of the intermediate transfer body). In such a case, since the ink heads 12C, 12M, 12Y and 12K do require depositing accuracy and the treatment liquid head 12P does not require such a high level of depositing accuracy, it is possible that the ejection is performed at a uniform ejection timing from the treatment liquid head 12P regardless of the determination results of the determination unit 34 whereas the ejection timings of the C, M, Y and K ink heads 12C, 12M, 12Y and 12K are determined on the basis of the determination results of the determination unit 34.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

a head which has a liquid ejection surface and performs liquid ejection in which liquid is ejected from the liquid ejection surface;

an intermediate transfer body moving in a movement direction with respect to the head and having an image forming surface that opposes the liquid ejection surface of the head and has an image forming region in which an image is formed by the liquid ejected from the liquid ejection surface of the head, and a rear surface which is reverse to the image forming surface and on which a line pattern constituted by pattern elements arranged equidistantly in the movement direction is formed;

a transfer device which transfers the image formed in the image forming region of the intermediate transfer body to a recording medium;

a reading device which is provided on an upstream side of the head in terms of the movement direction of the intermediate transfer body and reads light reflected by the line pattern; and an ejection control device which determines a movement speed and a movement distance of the intermediate transfer body from result obtained by reading the light by means of the reading device, generates an ejection control signal for the head according to the determined movement speed and the determined movement distance of the intermediate transfer body, and controls the liquid ejection of the head according to the ejection control signal, wherein:

a plurality of the heads are provided;

a plurality of the reading devices are provided in such a manner that n reading devices (where n is an integer not less than 2) are provided with respect to each of the plurality of the heads, the n reading devices being arranged in the movement direction of the intermediate transfer body at an arrangement interval of 1/n of an arrangement interval of the pattern elements of the line pattern.

2. The image forming apparatus as defined in claim 1, wherein the line pattern is disposed in a central portion, in terms of a direction perpendicular to the movement direction, of a pattern forming region of the rear surface of the intermediate transfer body, the pattern forming region corresponding to the image forming region.

3. The image forming apparatus as defined in claim 1, wherein a plurality of the line patterns are disposed in the movement direction respectively in vicinities of both edges of the image forming region in terms of a direction perpendicular to the movement direction.

4. The image forming apparatus as defined in claim 1, wherein:

a plurality of the heads corresponding to different types of the liquids are provided; and a plurality of the reading devices are provided in such a manner that at least one reading device is disposed on an upstream side of each of the heads in terms of the movement direction of the intermediate transfer body, and an arrangement interval between each of the reading devices and the head corresponding to each of the reading devices is less than an arrangement interval between the heads which are provided adjacently.

5. The image forming apparatus as defined in claim 4, wherein the plurality of the heads are arranged in the movement direction of the intermediate transfer body at an arrangement interval which is a multiple of m times an arrangement interval of the pattern elements of the line pattern (where m is an integer not less than 2).

6. The image forming apparatus as defined in claim 1, wherein:

a plurality of the heads are provided so as to include an ink ejection head ejecting ink containing coloring material and a treatment liquid deposition head depositing, onto the intermediate transfer body, treatment liquid which insolubilizes or aggregates the coloring material contained in the ink, the treatment liquid deposition head being arranged on an upstream side of the ink ejection head in terms of the movement direction of the intermediate transfer body; and a plurality of the reading devices are provided in such a manner that at least one reading device is provided on an upstream side in terms of the movement direction of the intermediate transfer body with respect to each of the plurality of the heads including the ink ejection head and the treatment liquid deposition head, and an arrangement interval between each of the reading devices and the head corresponding to each of the reading devices is less than an arrangement interval between the heads which are provided adjacently.

7. An image forming method comprising the steps of:

moving an intermediate transfer body in a movement direction with respect to a head which ejects liquid;

reading in light reflected by a line pattern constituted by pattern elements disposed equidistantly in the movement direction on a rear surface of the intermediate transfer body by using a reading device provided on an upstream side of the head in terms of the movement direction of the intermediate transfer body, the rear surface being reverse to an image forming surface of the intermediate transfer body opposing a liquid ejection surface of the head;

determining a movement speed and a movement interval of the intermediate transfer body from result obtained by reading the light by means of the reading device;

generating an ejection control signal for the head according to the determined movement speed and the determined movement interval of the intermediate transfer body;

causing the head to eject the liquid according to the ejection control signal so as to form an image on the image forming surface of the intermediate transfer body; and transferring the image formed on the image forming surface of the intermediate transfer body to a recording medium, wherein:

a plurality of the heads are provided;

a plurality of the reading devices are provided in such a manner that n reading devices (where n is an integer not less than 2) are provided with respect to each of the plurality of the heads, the n reading devices being arranged in the movement direction of the intermediate transfer body at an arrangement interval of 1/n of an arrangement interval of the pattern elements of the line pattern.

* * * * *

UNITED STATES PATENT AND TRADEMARK OFFICE

CERTIFICATE OF CORRECTION

PATENT NO. : 8,033,662 B2
APPLICATION NO. : 11/902894
DATED : October 11, 2011
INVENTOR(S) : Masaaki Konno It is certified that error appears in the above-identified patent and that said Letters Patent is hereby corrected as shown below:

On the Title Page:

Item (54) and at column 1, lines 1-5, correct the title to read:

--IMAGE FORMING APPARATUS AND METHOD FOR PREVENTING IMAGE DETERIORATION DUE TO SPEED VARIATION IN AN INTERMEDIATE TRANSFER BODY--.

In the Specifications:

Column 1, Lines 1-5, should read:

--IMAGE FORMING APPARATUS AND METHOD FOR PREVENTING IMAGE DETERIORATION DUE TO SPEED VARIATION IN AN INTERMEDIATE TRANSFER BODY--.

Signed and Sealed this
Twenty-ninth Day of November, 2011

David J. Kappos

David J. Kappos
*Director of the United States Patent and Trademark Office*